US011623130B2

(12) United States Patent
Vaillancourt

(10) Patent No.: US 11,623,130 B2
(45) Date of Patent: Apr. 11, 2023

(54) HOCKEY GOALKEEPER LEG PADS

(71) Applicant: BAUER HOCKEY LTD., Blainville (CA)

(72) Inventor: Charles Vaillancourt, Blainville (CA)

(73) Assignee: BAUER HOCKEY LLC, Exeter, NH (US)

( * ) Notice: Subject to any disclaimer, the term of this patent is extended or adjusted under 35 U.S.C. 154(b) by 52 days.

(21) Appl. No.: 16/414,997

(22) Filed: May 17, 2019

(65) Prior Publication Data

US 2019/0351311 A1 Nov. 21, 2019

Related U.S. Application Data

(60) Provisional application No. 62/672,906, filed on May 17, 2018.

(51) Int. Cl.

| | |
|---|---|
| ***A63B 71/12*** | (2006.01) |
| ***A41D 13/05*** | (2006.01) |
| *A63B 102/24* | (2015.01) |
| *A63B 102/22* | (2015.01) |

(52) U.S. Cl.

CPC ..... *A63B 71/1225* (2013.01); *A41D 13/0543* (2013.01); *A41D 2300/32* (2013.01); *A41D 2600/10* (2013.01); *A63B 2071/125* (2013.01); *A63B 2071/1241* (2013.01); *A63B 2071/1258* (2013.01); *A63B 2071/1266* (2013.01); *A63B 2071/1275* (2013.01); *A63B 2071/1283* (2013.01); *A63B 2102/22* (2015.10); *A63B 2102/24* (2015.10); *A63B 2209/00* (2013.01)

(58) Field of Classification Search

CPC ..... A63B 71/1225; A63B 2102/22; A63B 2102/24; A63B 2071/1241; A63B 2071/125; A63B 2071/1258; A63B 2071/1266; A63B 2071/1275; A63B 2071/1283; A63B 2209/00; A63B 2209/10; A63B 2225/09; A41D 13/0543; A41D 2600/10; A41D 2300/32

USPC ..... 2/22

See application file for complete search history.

(56) References Cited

U.S. PATENT DOCUMENTS

| | | | | |
|---|---|---|---|---|
| 2,785,407 A | | 3/1957 | Reeder | |
| 3,877,077 A | * | 4/1975 | Chapdelaine | A63B 71/1225 2/22 |
| 4,136,226 A | | 1/1979 | Gilman | |
| 4,868,926 A | * | 9/1989 | Lowson | A63B 71/1225 2/22 |
| 4,980,110 A | | 12/1990 | Nelson et al. | |
| 5,093,931 A | * | 3/1992 | LaBerge | A63B 71/12 2/22 |
| 5,172,425 A | * | 12/1992 | Smith | A63B 71/1225 2/22 |

(Continued)

OTHER PUBLICATIONS

Examiner's Report dated Jun. 8, 2020 in connection with Canadian Patent Application No. 3,043,833, 4 pages.

(Continued)

*Primary Examiner* — Sally Haden

(57) ABSTRACT

Hockey goalkeeper leg pads wearable on legs of a hockey goalkeeper to protect the legs, in which protective parts (e.g., pad members) of the hockey goalkeeper leg pads are adjustable to adjust how the hockey goalkeeper leg pads fit on the legs, and their adjustability is provided in a way that may be relatively light, easy to use, and simple to manufacture.

33 Claims, 21 Drawing Sheets

(56) References Cited

U.S. PATENT DOCUMENTS 5,273,702 A 12/1993 Nelson
5,361,410 A 11/1994 Sigi
5,452,475 A * 9/1995 Hunt, Jr. ..... A63B 71/1225 2/22
5,617,580 A * 4/1997 DiCesare ..... A63B 71/1225 2/22
D396,134 S * 7/1998 Shikatani ..... D29/120.1
5,784,715 A * 7/1998 Buchanan ..... A63B 71/1225 2/22
5,806,092 A * 9/1998 Shikatani ..... A63B 71/1225 2/22
6,282,724 B1 9/2001 Abraham et al.
D455,871 S * 4/2002 Di Biase ..... D29/120.1
6,468,239 B1 10/2002 Mollura et al.
6,560,781 B1 * 5/2003 Keene ..... A63B 71/1225 2/22
6,964,062 B1 * 11/2005 Chen ..... A41D 13/065 2/22
D554,295 S * 10/2007 Darche ..... D29/120.1
D554,296 S * 10/2007 Darche ..... D29/120.1
8,261,369 B2 * 9/2012 Sioui ..... A63B 71/1225 2/22
D674,149 S * 1/2013 Smith ..... D29/120.1
D683,907 S * 6/2013 Smith ..... D29/120.1
9,440,136 B2 * 9/2016 Smith ..... A43B 5/18
9,861,152 B1 1/2018 Rumfelt
10,391,686 B2 8/2019 Kuroki et al.
2002/0162153 A1 * 11/2002 Collins ..... A63B 71/1225 2/22
2005/0015841 A1 * 1/2005 Hoffman ..... A41D 13/05 2/22
2005/0071906 A1 * 4/2005 Infante ..... A63B 71/1225 2/22
2006/0026732 A1 2/2006 Nordt et al.
2007/0050876 A1 * 3/2007 Whitmire ..... A41D 13/0543 2/22
2007/0180594 A1 * 8/2007 Ashby-Bey ..... A41D 13/0568 2/22
2007/0214538 A1 * 9/2007 Castonguay ..... A63B 71/1225 2/22
2007/0250977 A1 * 11/2007 Brown ..... A41D 13/0543 2/22
2008/0201814 A1 * 8/2008 Goyer ..... A41D 13/0543 2/22
2009/0025114 A1 * 1/2009 Hudon ..... A63B 71/1225 2/22
2009/0210990 A1 * 8/2009 Taylor ..... A41D 13/0543 2/22
2010/0107291 A1 * 5/2010 Carter ..... F41H 1/02 2/2.5
2010/0138971 A1 * 6/2010 McVeigh ..... A63B 69/0002 2/22
2010/0192269 A1 * 8/2010 Saranga ..... A41D 13/0543 2/24
2013/0025017 A1 * 1/2013 Chen ..... A41D 13/065 2/22
2013/0318675 A1 * 12/2013 Mackey ..... A63B 71/1225 2/22
2014/0082812 A1 * 3/2014 Keehu ..... A63B 71/1225 2/22
2014/0259259 A1 * 9/2014 Smith ..... A63B 71/1225 2/22
2014/0259261 A1 * 9/2014 Mackey ..... A63B 71/1225 2/22
2015/0033433 A1 * 2/2015 Mackey ..... A63B 69/0026 2/22
2015/0106991 A1 * 4/2015 Gouniot ..... A43B 5/0415 2/24
2015/0128325 A1 * 5/2015 Vaughn ..... A63B 71/1225 2/22
2016/0038821 A1 * 2/2016 Mackey ..... A43B 1/0072 2/459
2016/0354672 A1 * 12/2016 Smith ..... A43B 5/18
2017/0055603 A1 * 3/2017 Guidetti ..... A41D 13/0543
2018/0292177 A1 * 10/2018 Roby ..... A41D 13/0543
2018/0326290 A1 * 11/2018 Rodrick ..... A41D 13/0153
2019/0011216 A1 1/2019 Carlston
2019/0038956 A1 * 2/2019 Contant ..... A41D 13/0543
2019/0308086 A1 * 10/2019 Filiatrault-Giroux ..... A63B 71/1225
2020/0070035 A1 3/2020 Vaillancourt et al.

OTHER PUBLICATIONS

Examiner's Report dated Dec. 30, 2020 in connection with Canadian Patent Application No. 3,043,833, 8 pages.
Non-Final Office Action dated Jun. 8, 2021 in connection with U.S. Appl. No. 16/560,373, 36 pages.
Non-Final Office Action dated Oct. 25, 2022 in connection with U.S. Appl. No. 16/560,373, 60 pages.
Advisory Action dated Jun. 15, 2022 in conneciton with U.S. Appl. No. 16/560,373, 3 pages.
Final Office Action dated Mar. 14, 2022 in connection with U.S. Appl. No. 16/560,373, 64, pages.

* cited by examiner

HOCKEY GOALKEEPER LEG PADS

CROSS-REFERENCE TO RELATED APPLICATION

This application claims priority from U.S. Provisional Patent Application 62/672,906 filed on May 17, 2018 and incorporated by reference herein.

FIELD

This disclosure relates generally to protective hockey equipment and, more particularly, to hockey goalkeeper leg pads for protecting legs of hockey goalkeepers.

BACKGROUND

Hockey goalkeepers (a.k.a. goalies) defend their team's goal in a hockey game, and, to that end, they wear various equipment, including leg pads to protect their legs against impacts from pucks, balls, hockey sticks or other objects and/or when moving (e.g., dropping) them onto a playing surface (e.g., ice).

A hockey goalkeeper leg pad comprises protective padding for providing padded protection to a hockey goalkeeper's leg and may include one or more adjustable parts in order to adjust a fit of the leg pad on the hockey goalkeeper's leg. For example, a pad member (e.g., knee pad member) of the leg pad may be adjustable using one or more straps and hook-and-loop fasteners to adjust where it is positioned relative to the hockey goalkeeper's leg.

While existing systems to adjust parts of hockey goalkeeper leg pads are useful, they can also cause some issues, such as adding weight to the leg pads.

For these and other reasons, improvements in hockey goalkeeper leg pads would be welcomed.

SUMMARY

According to various aspects, this disclosure relates to hockey goalkeeper leg pads wearable on legs of a hockey goalkeeper to protect the legs, in which protective parts (e.g., pad members) of the hockey goalkeeper leg pads are adjustable to adjust how the hockey goalkeeper leg pads fit on the legs, and their adjustability is provided in a way that may be relatively light, easy to use, and simple to manufacture.

For example, according to one aspect, this disclosure relates to a hockey goalkeeper leg pad wearable on a leg of a hockey goalkeeper to protect the leg. The hockey goalkeeper leg pad comprises a first pad member; a second pad member connected to the first pad member; and an adjustment system configured to adjust the second pad member relative to the first pad member. The adjustment system comprises a connector of the first pad member and a connector of the second pad member that are connected to one another hook-and-loop fastenerlessly and allow the second pad member to be adjusted relative to the first pad member.

According to another aspect, this disclosure relates to a hockey goalkeeper leg pad wearable on a leg of a hockey goalkeeper to protect the leg. The hockey goalkeeper leg pad comprises a first pad member; a second pad member connected to the first pad member; and an adjustment system configured to adjust the second pad member relative to the first pad member. The adjustment system comprises a connector of the first pad member and a connector of the second pad member connected to one another and allow the second pad member to be adjusted relative to the first pad member. The connector of the second pad member is connected to the connector of the first pad member without folding back onto the second pad member.

According to another aspect, this disclosure relates to a hockey goalkeeper leg pad wearable on a leg of a hockey goalkeeper to protect the leg. The hockey goalkeeper leg pad comprises a first pad member; a second pad member connected to the first pad member; and an adjustment system configured to adjust the second pad member relative to the first pad member. The adjustment system comprises a connector of the first pad member and a connector of the second pad member that are connected to one another and allow the second pad member to be adjusted relative to the first pad member. The connector of the first pad member comprises an opening. The connector of the second pad member extends into the opening to connect the second pad member to the first pad member. The connector of the second pad member comprises an elongated portion and an enlarged portion that is larger than the elongated portion and configured to retain the connector of the second pad member into the opening of the first pad member.

These and other aspects of this disclosure will now become apparent upon review of a description of embodiments that follows in conjunction with accompanying drawings.

BRIEF DESCRIPTION OF DRAWINGS

A detailed description of embodiments is provided below, by way of example only, with reference to accompanying drawings, in which.

The description and drawings are only for purposes of illustrating certain embodiments and are an aid for understanding. They are not intended to be limiting.

DETAILED DESCRIPTION OF EMBODIMENTS

Figure 1:
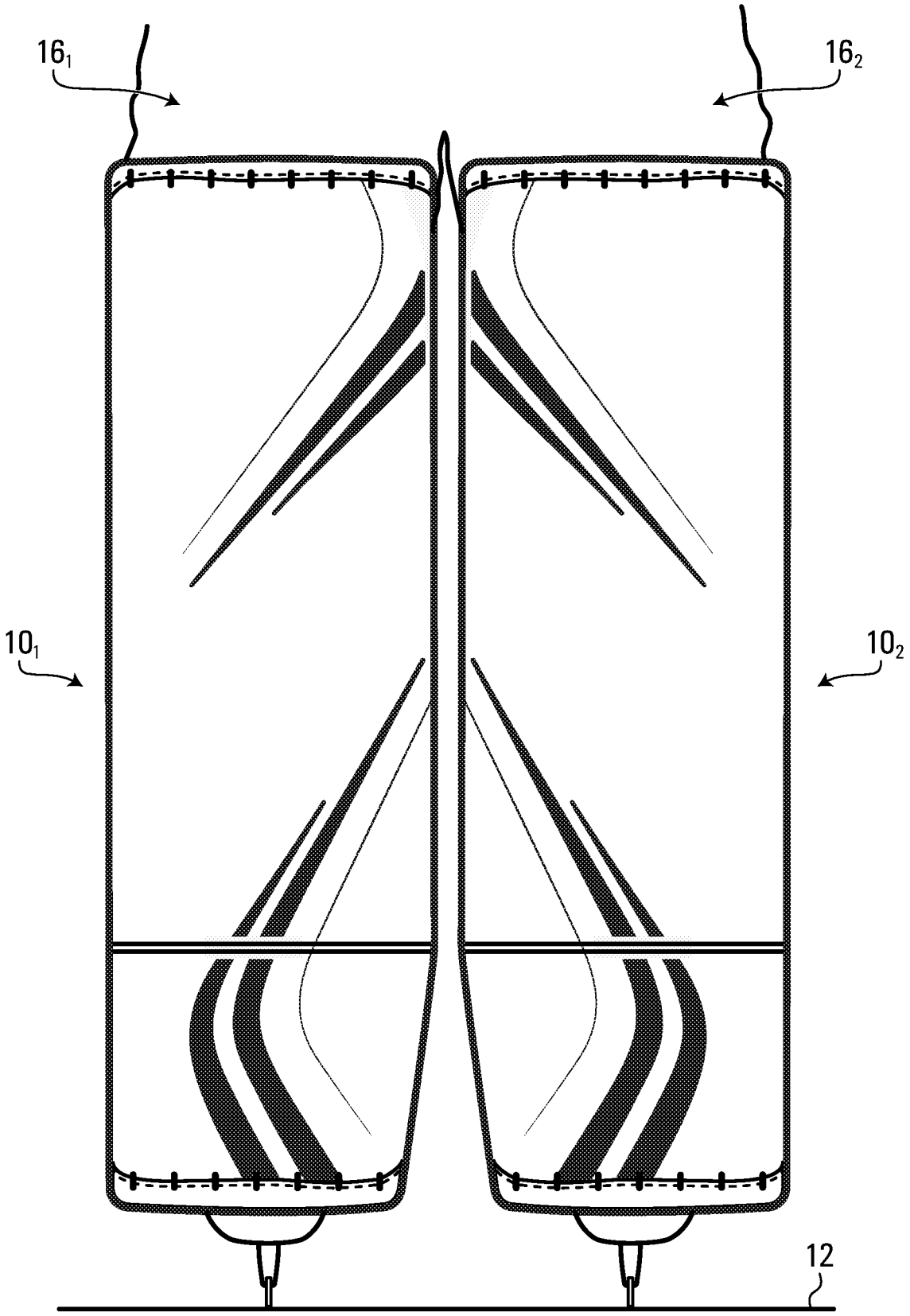
FIG. 1 shows a front view of an embodiment of hockey goalkeeper leg pads for protecting legs of a hockey goalkeeper.
Figure 2:
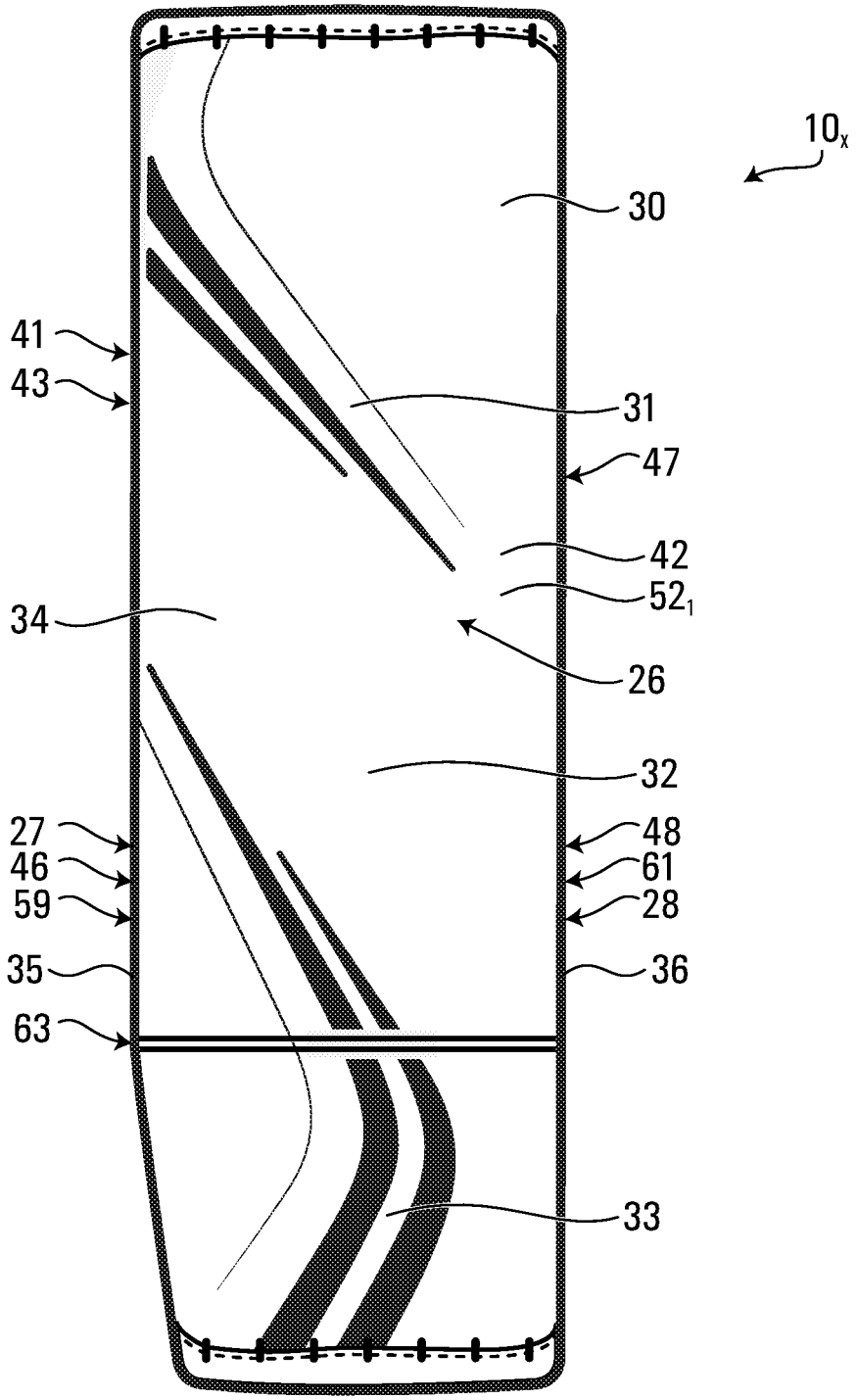
FIG. 2 shows a front view of a left one of the leg pads.
Figure 3:
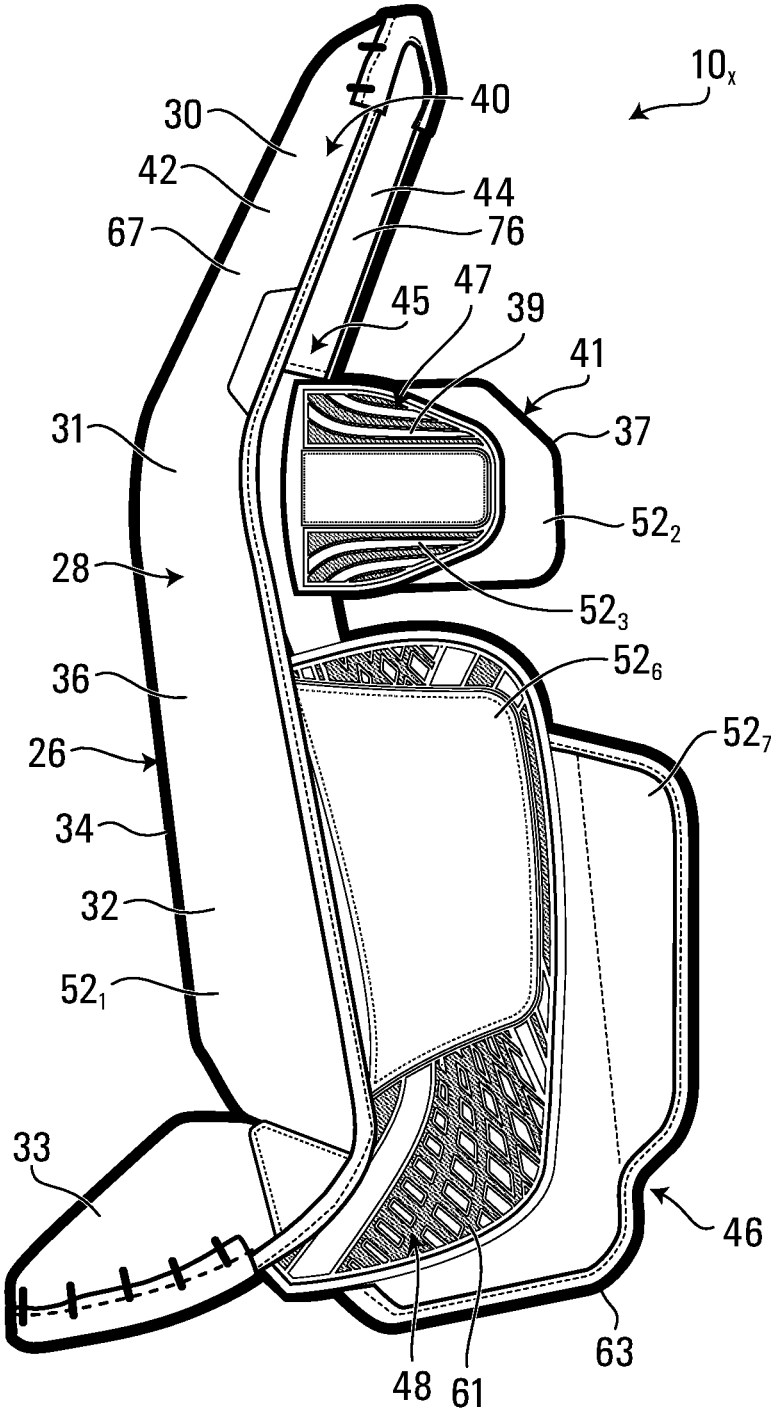
FIG. 3 shows a lateral view of the leg pad.
Figure 4:
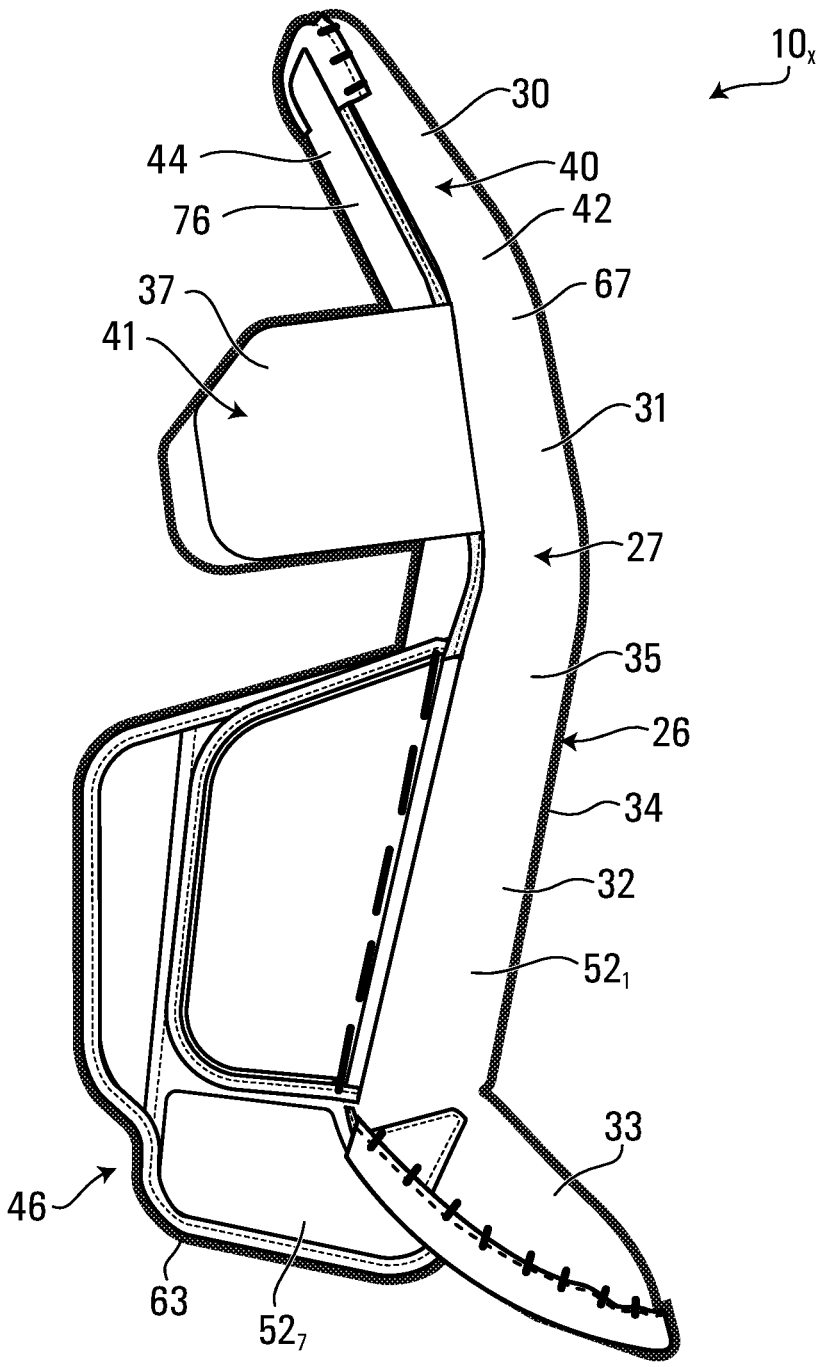
FIG. 4 shows a medial view of the leg pad.
Figure 5:
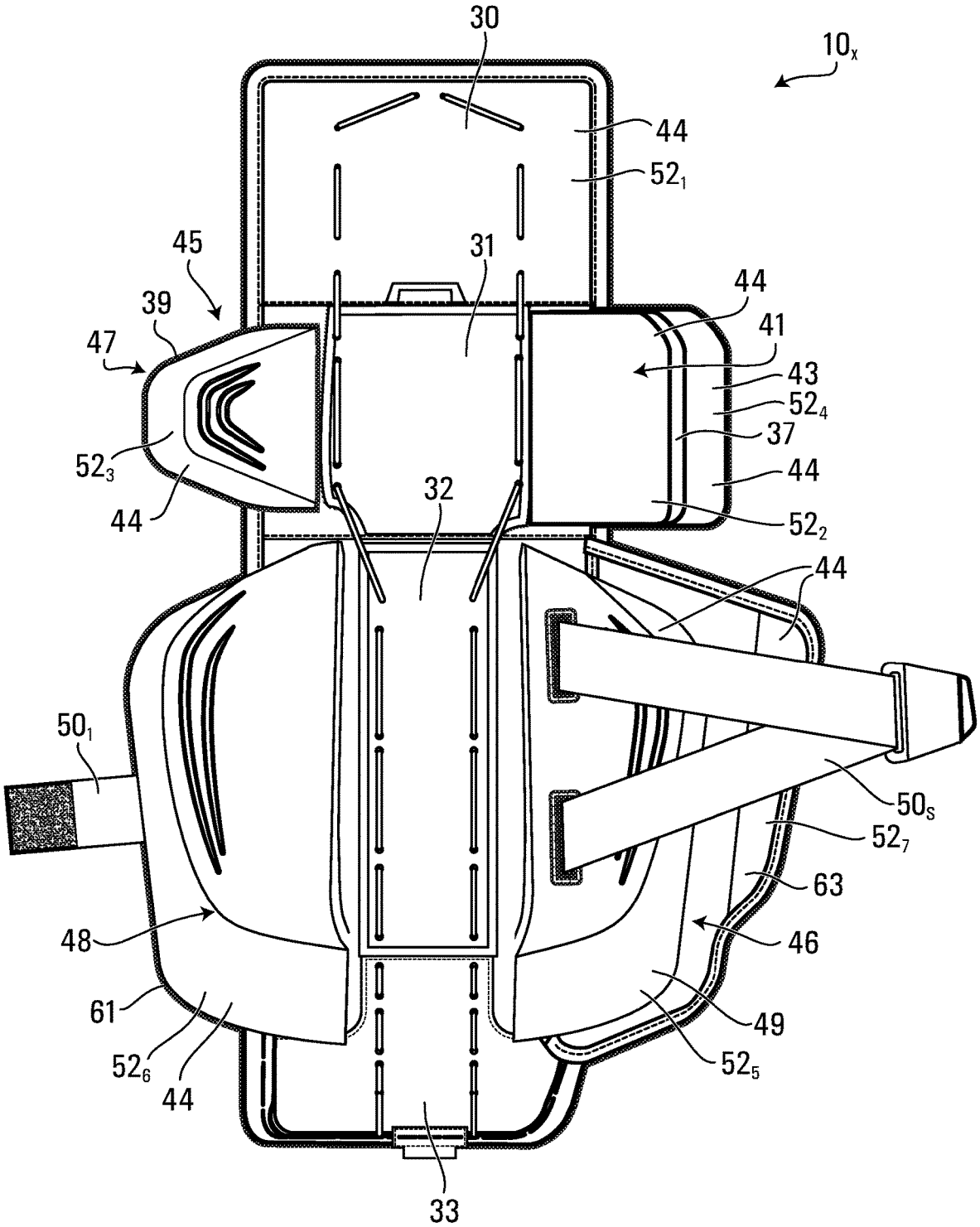
FIG. 5 shows the leg pad from an inner side.
Figure 6A:
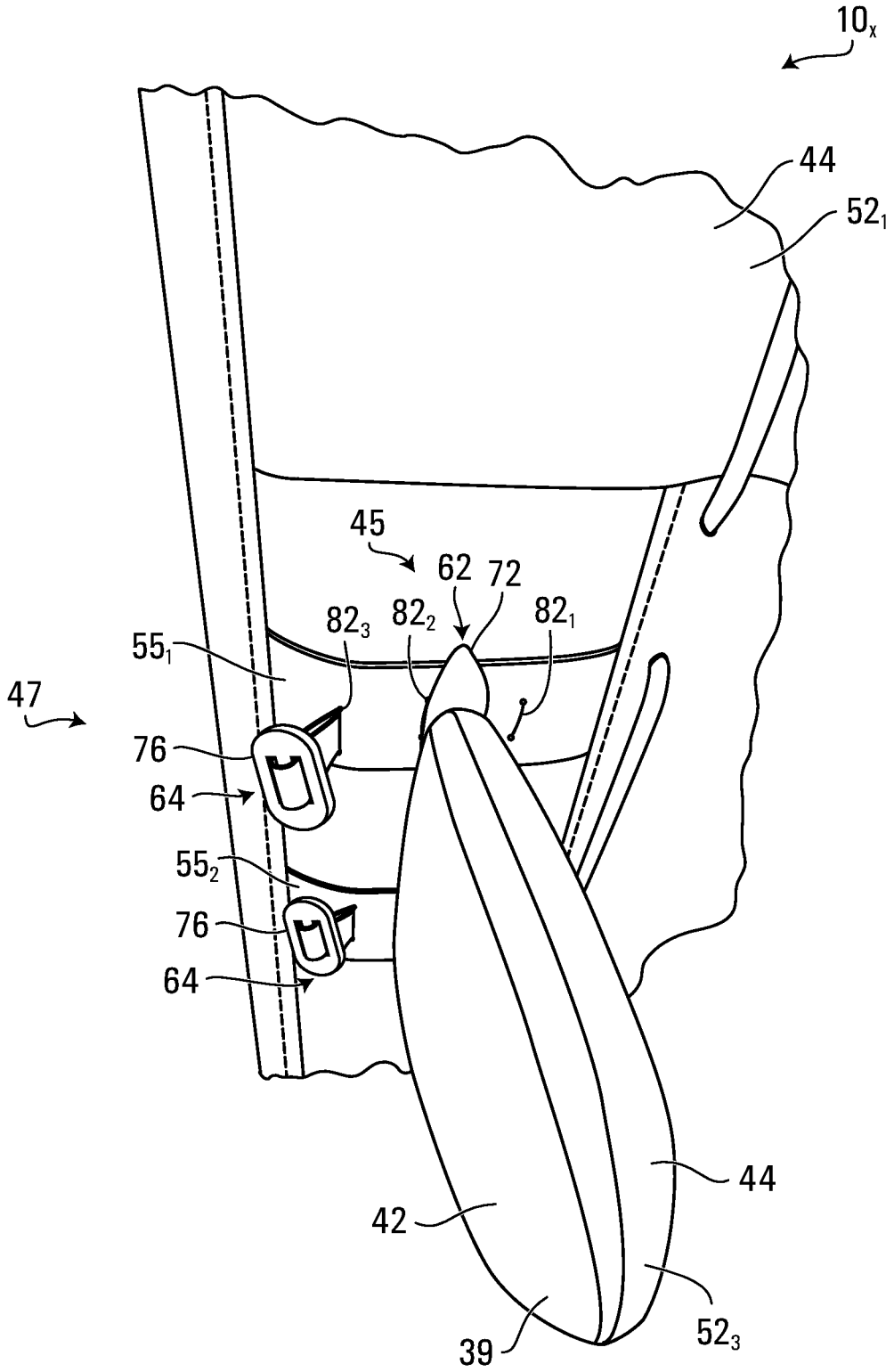
FIGS. 6A to 6D show an adjustment system of the leg pad.
Figure 6B:
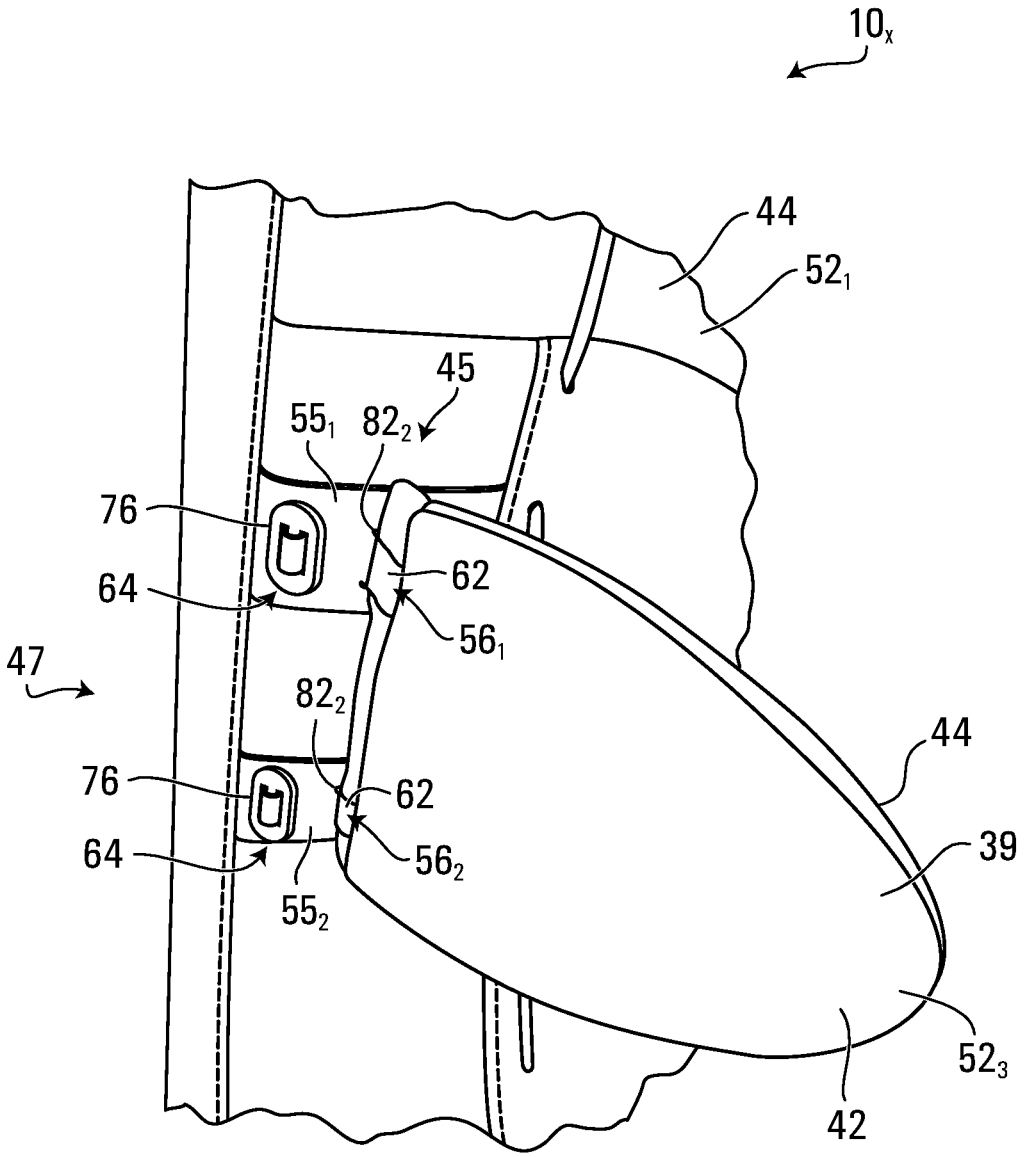
Figure 6C:
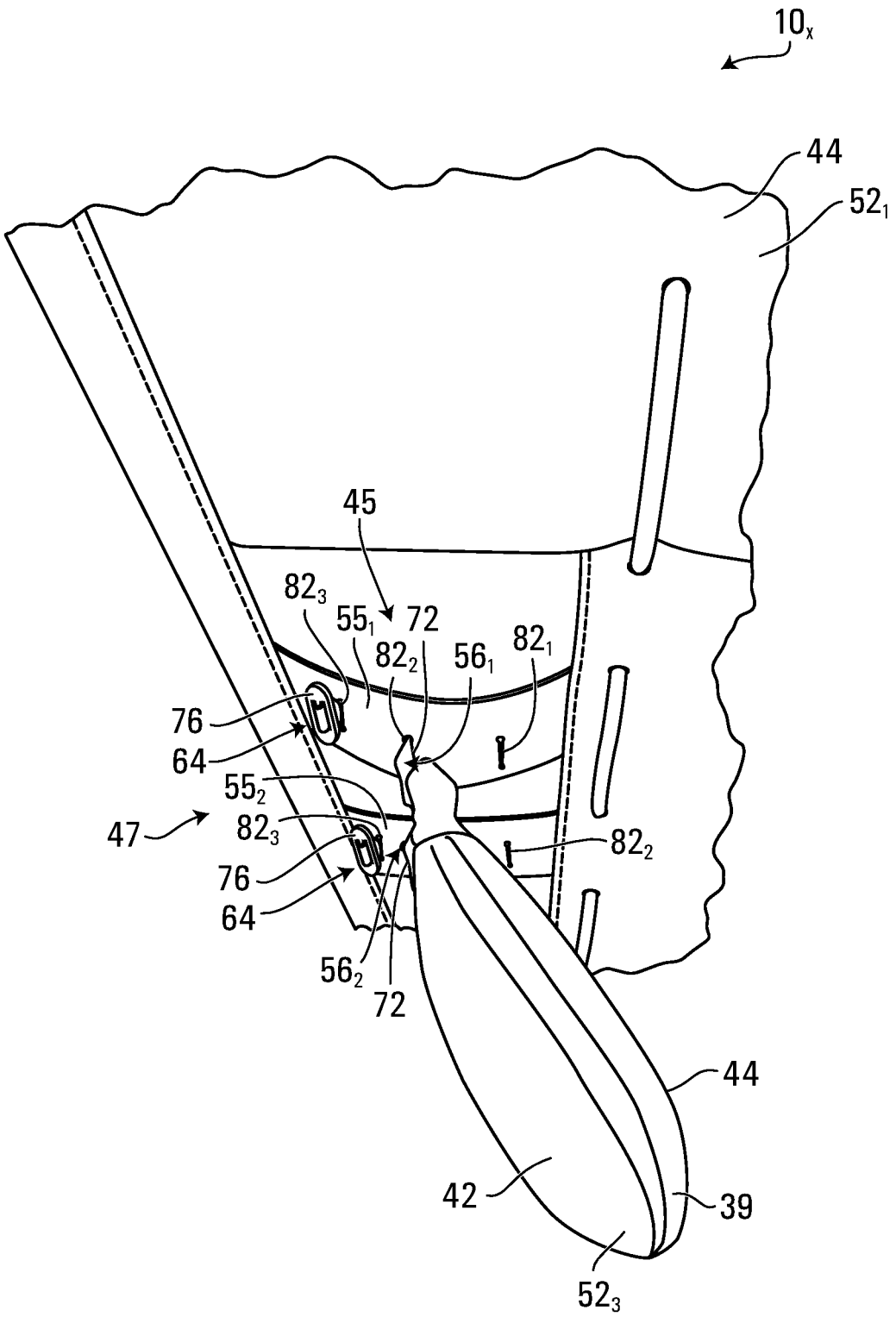
Figure 6D:
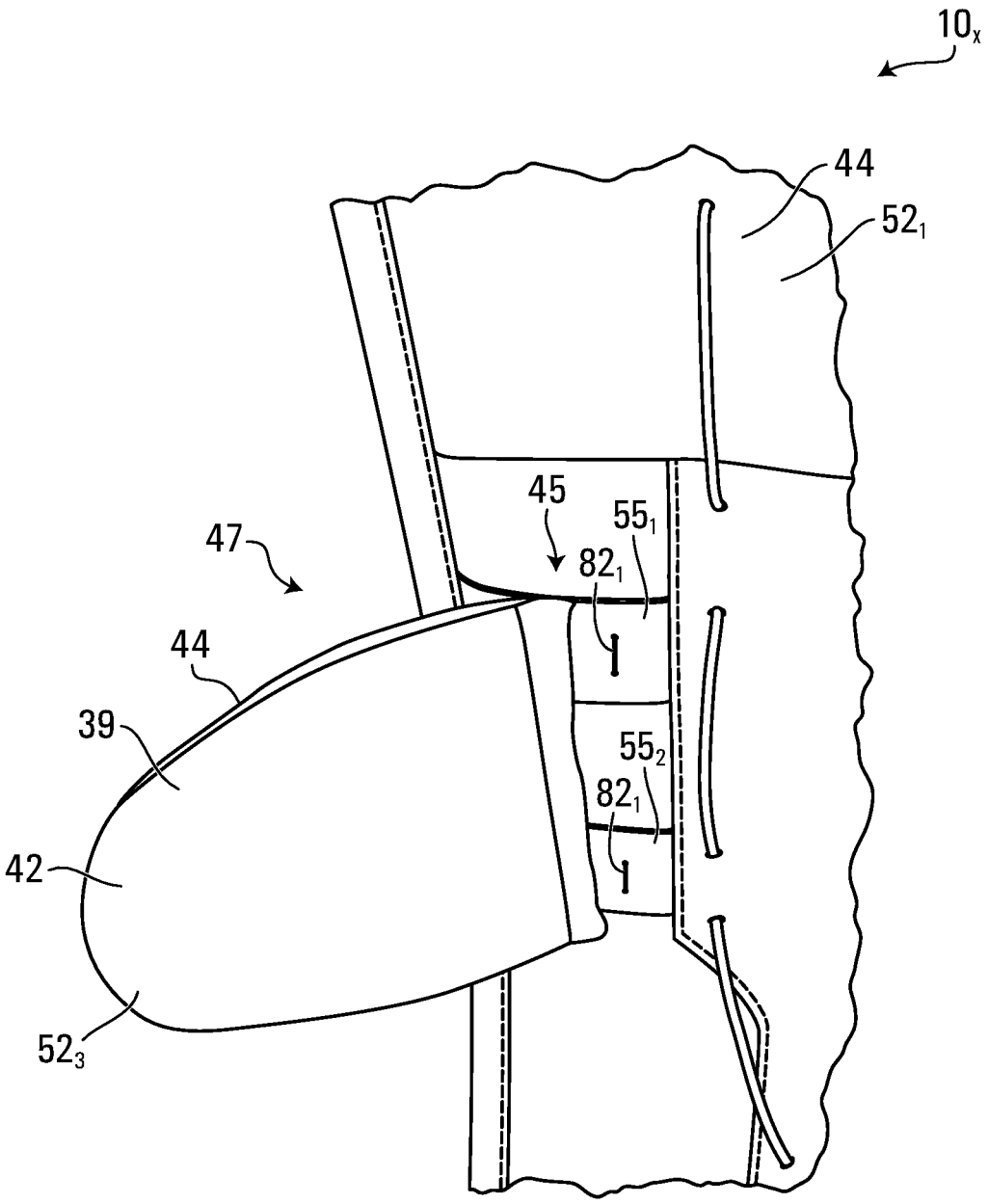
Figure 7:
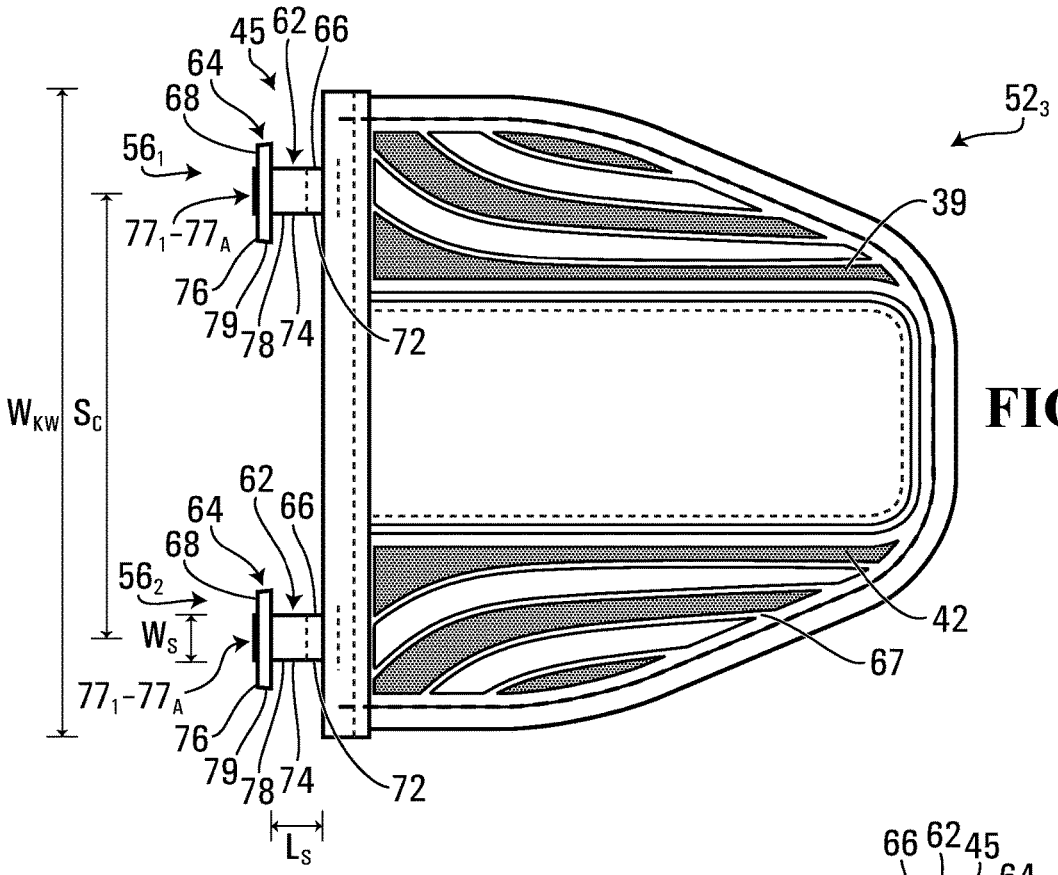
FIG. 7 shows an outer view of a lateral knee wing of the leg pad.
Figure 8:
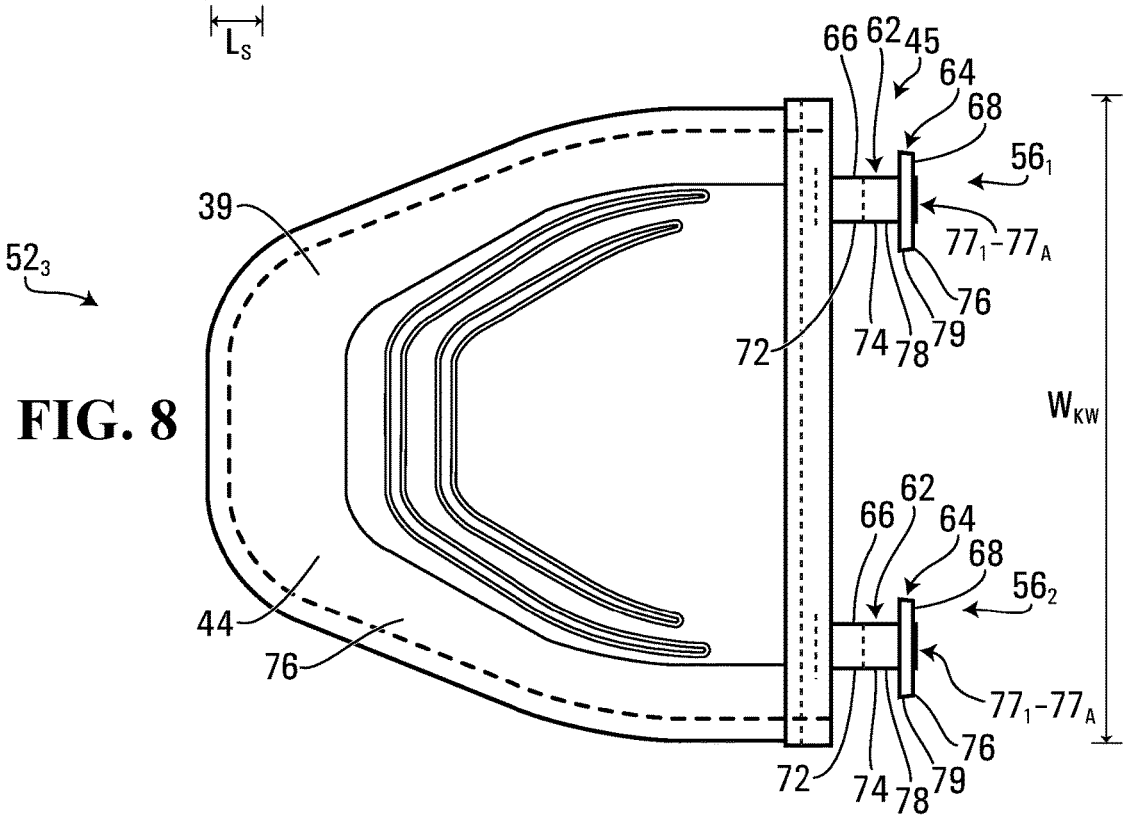
FIG. 8 shows an inner view of the lateral knee wing of the leg pad.
Figure 9:
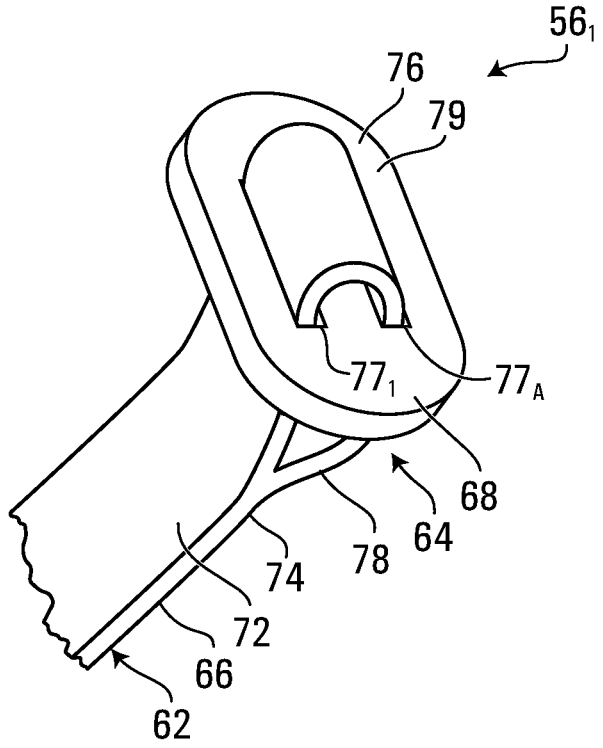
FIG. 9 shows a connector of the lateral knee wing of the leg pad.
Figure 10:
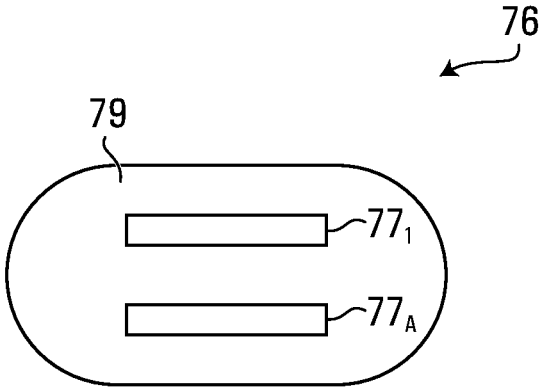
FIGS. 10 and 11 show a button of the connector of the lateral knee wing of the leg pad.
Figure 11:
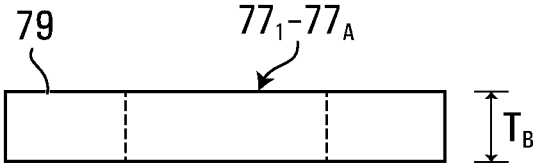
Figure 12:
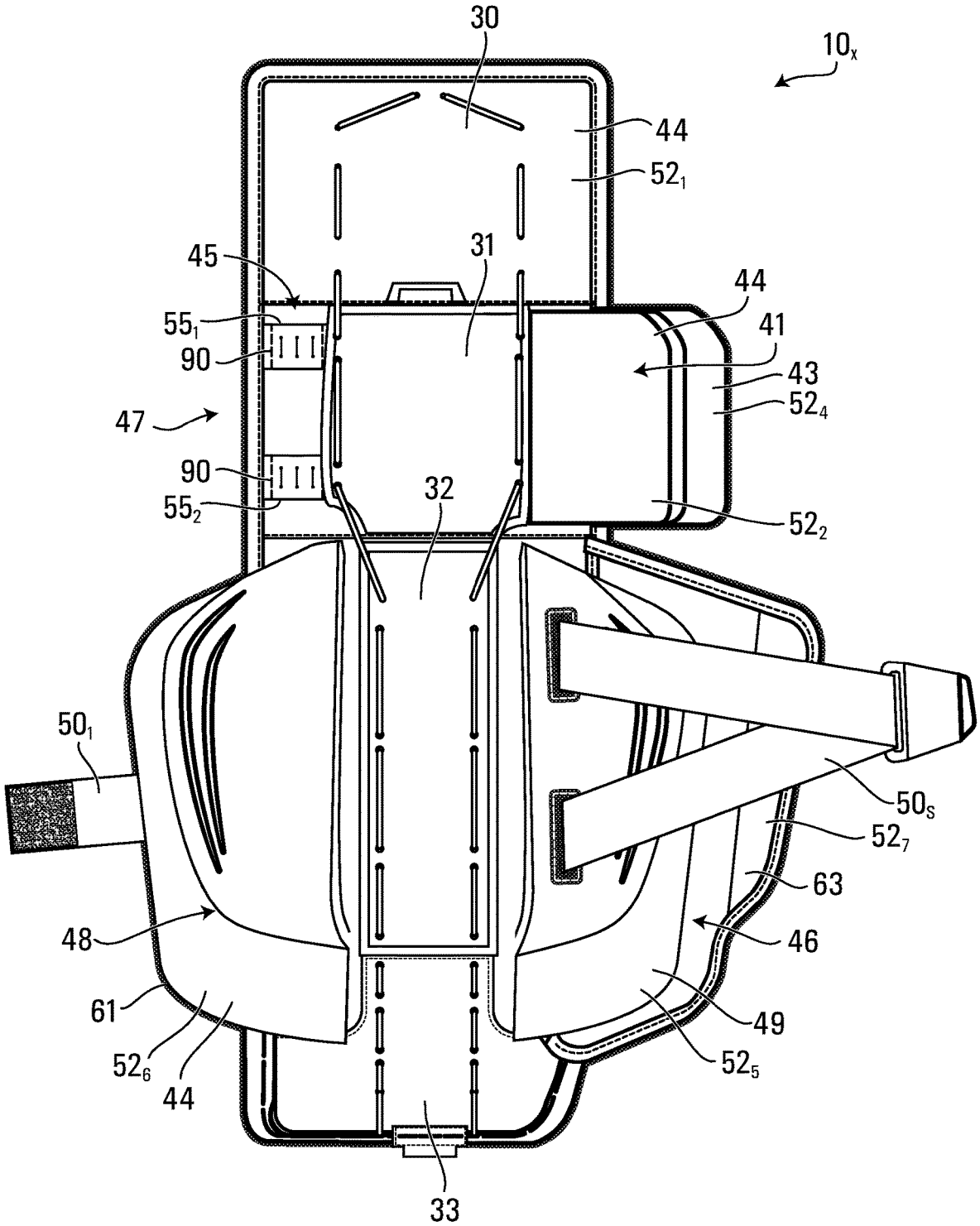
FIGS. 12 and 13 show the leg pad from the inner side with the lateral knee wing removed from the leg pad.
Figure 13:
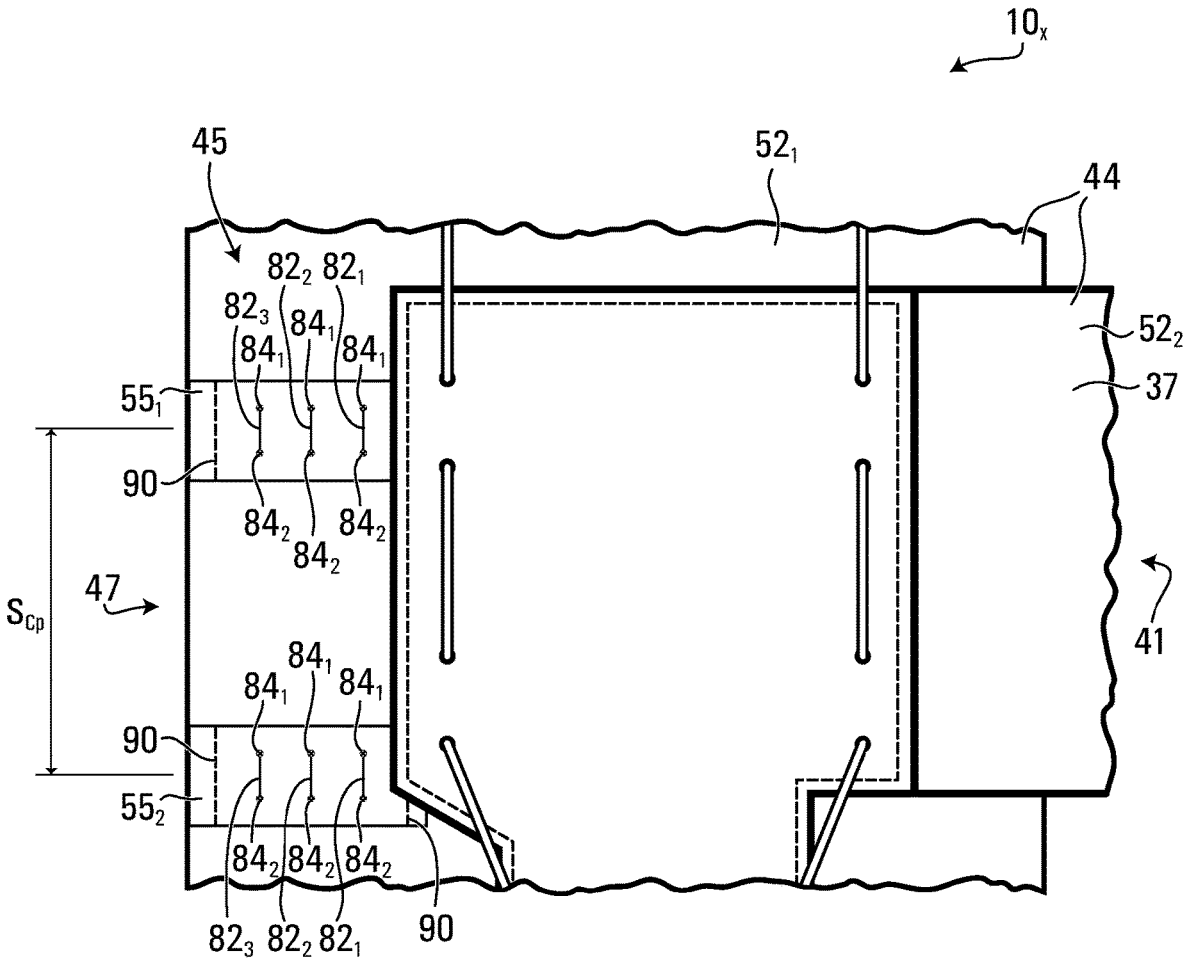
Figure 14:
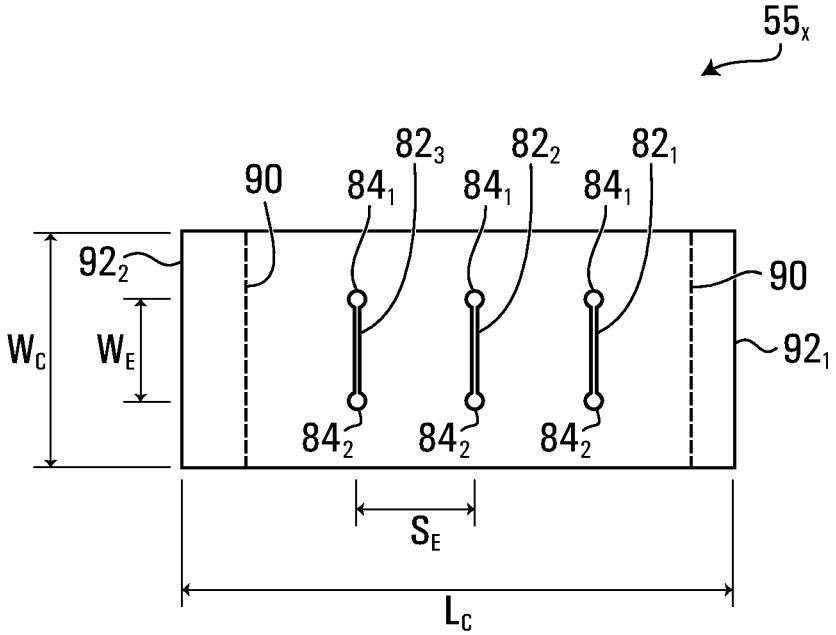
FIGS. 14 and 15 show a connector of the leg pad.
Figure 15:
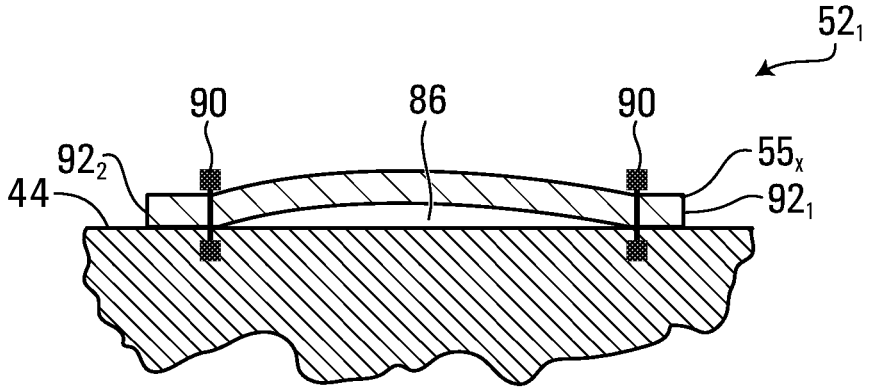

FIG. 1 shows an embodiment of hockey goalkeeper leg pads $\mathbf{10}_1$, $\mathbf{10}_2$ wearable on a hockey goalkeeper's legs $\mathbf{16}_1$, $\mathbf{16}_2$ while playing hockey to protect the legs $\mathbf{16}_1$, $\mathbf{16}_2$ against an impact from a puck, ball, hockey stick or other object and/or to protect the legs $\mathbf{16}_1$, $\mathbf{16}_2$ when moving (e.g., dropping) them onto a playing surface 12. The hockey goalkeeper may be referred to as a "goalie" and thus the hockey goalkeeper leg pads $10_1$, $10_2$ may be referred to as "goalie leg pads", "goalie pads", or just "leg pads" of the goalie. In this embodiment, a type of hockey played is ice hockey such that the goalie pads $10_1$, $10_2$ are ice hockey goalie pads, the goalie is an ice hockey goalie, and the playing surface 12 is ice.

As further discussed later, in this embodiment, protective parts (e.g., pad members) of the goalie pads $10_1$, $10_2$ are adjustable to adjust how the goalie pads $10_1$, $10_2$ fit on the goalie's legs $16_1$, $16_2$, and their adjustability is provided in a way that is relatively light, easy to use, and simple to manufacture.

Figure 23:
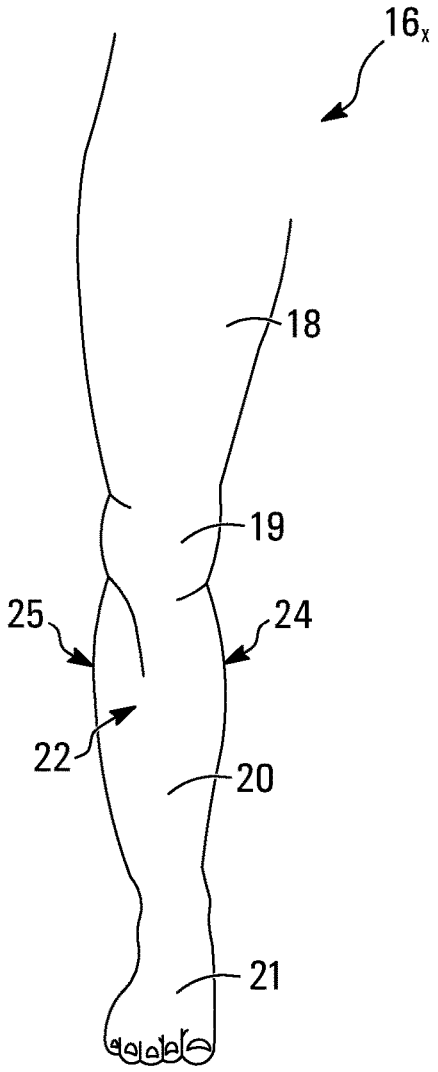
FIGS. 23 and 24 show a leg of the hockey goalkeeper.
Figure 24:
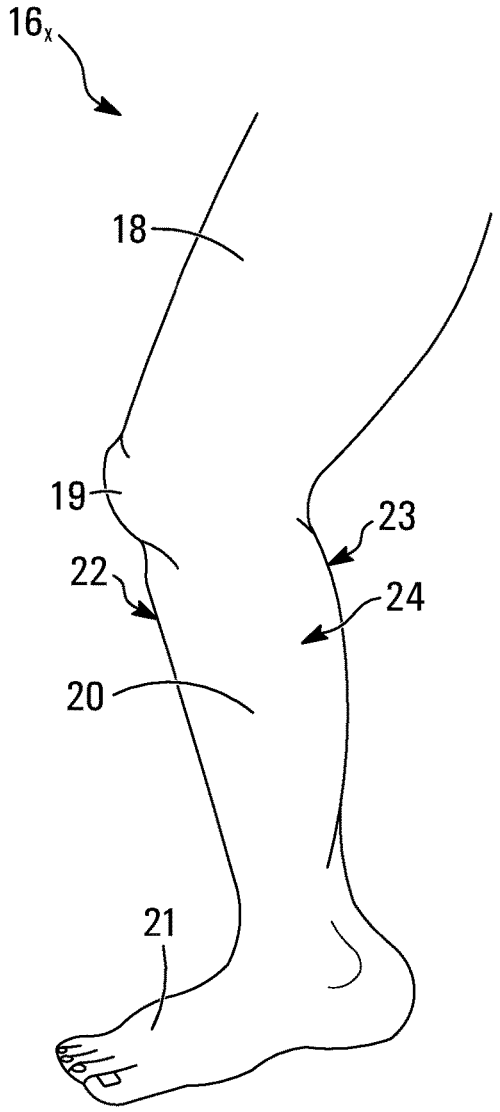

The goalie pads $10_1$, $10_2$ protect various regions of the goalie's legs $16_1$, $16_2$. With additional reference to FIGS. 23 and 24, each leg $16_x$ of the goalie comprises an upper leg region 18, a knee 19, a lower leg region 20, and a foot 21. The upper leg region 18 is above the knee 19, while the lower leg region 20 is below the knee 19 and above the foot 21. The leg $16_x$ of the goalie has a front 22, a back 23, a medial side 24 (sometimes referred to as an "inner side"), and a lateral side 25 (sometimes referred to as an "outer side").

Each goalie pad $10_x$ comprises an upper leg portion 30, a knee portion 31, a lower leg portion 32, and a foot portion 33 respectively configured to be positioned adjacent to the upper leg region 18, the knee 19, the lower leg region 20, and the foot 21 of the goalie's leg $16_x$ when the goalie pad $10_x$ is worn on the leg $16_x$. The upper leg portion 30 is above the knee portion 31, while the lower leg portion 32 is below the knee portion 31 and above the foot portion 33.

Respective ones of these portions of the goalie pad $10_x$ comprise frontal, medial, and lateral parts such that the goalie pad $10_x$ comprises a frontal portion 26, a medial portion 27, and a lateral portion 28 respectively configured to be positioned adjacent to the front 22, the medial side 24, and the lateral side 25 of the goalie's leg $16_x$ when the goalie pad $10_x$ is worn on the leg $16_x$. The frontal portion 26 comprises a front 34 of the goalie pad $10_x$, the medial portion 27 comprises a medial side 35 of the goalie pad $10_x$, and the lateral portion 28 comprises a lateral side 36 of the goalie pad $10_x$. A longitudinal direction of the goalie pad $10_x$ is substantially parallel to a longitudinal axis of the goalie's leg $16_x$, a lateral (i.e., widthwise) direction of the goalie pad $10_x$ is perpendicular to its longitudinal direction and substantially parallel to a dextrosinistral axis of the goalie's leg $16_x$, and a front-back direction of the goalie pad $10_x$ is perpendicular to its longitudinal direction and substantially parallel to a dorsoventral axis of the goalie's leg $16_x$.

In this embodiment, the knee portion 31 comprises a medial part 41 including a medial knee wing 37 and a lateral part 47 including a lateral knee wing 39 that project rearwardly and define a knee cradle to receive the goalie's knee 19. The medial part 41 of the knee portion 31 also comprises a knee landing 43 projecting rearwardly and configured to engage the goalie's knee 19 when dropping to the ice 12 (e.g., in a butterfly position). Similarly, in this embodiment, the lower leg portion 32 comprises a medial part 46 including a medial calf wing 49 and a lateral part 48 including a lateral calf wing 61 that project rearwardly to receive the goalie's lower leg 20. The medial part 46 of the lower leg portion 32 also comprises a calf landing 63 to engage the goalie's lower leg 20 when dropping to the ice 12.

The goalie pad $10_x$ can be secured to the goalie's leg $16_x$ in any suitable way. In this embodiment, the goalie pad $10_x$ comprises straps $50_1$-$50_S$ to secure it to the goalie's leg $16_x$.

As shown in FIGS. 2 to 5, in this embodiment, the goalie pad $10_x$ comprises pad members $52_1$-$52_7$ that are part of its upper leg portion 30, its knee portion 31, its lower leg portion 32, and its foot portion 33 and configured to protect the goalie's leg $16_x$ against an impact from a puck, ball, hockey stick or other object and/or when moving (e.g., dropping) them onto the ice 12. More particularly, in this embodiment, the pad member $52_1$ is a main pad member of the goalie pad $10_x$ that is largest and part of the upper leg portion 30, the knee portion 31, the lower leg portion 32, and the foot portion 33, while the medial knee wing 37 comprises the pad member $52_2$, the lateral knee wing 39 comprises the pad member $52_3$, the knee landing 43 comprises the pad member $52_4$, the medial calf wing 49 comprises the pad member $52_5$, the lateral calf wing 61 comprises the pad member $52_6$, and the calf landing 63 comprises the pad member $52_7$.

Each pad member $52_i$ may comprise an outer cover 42, an inner liner 44, and protective padding 40 disposed between the outer cover 42 and the inner liner 44.

The outer cover 42 of each pad member $52_i$ is configured to face away from the goalie's leg $16_x$. A material 67 of the outer cover 42 may be of any suitable kind. For example, in some embodiments, the material 67 of the outer cover 42 may be a synthetic pliable material such as synthetic leather (e.g., polyurethane (PU) leather) or fabric (e.g., nylon fabric, polyester fabric, etc.) that is provided as a panel cut into a desired configuration so as to cover the protective padding 40 of the pad member $52_i$. As another example, in some embodiments, the material 67 of the outer cover 42 be a molded material (e.g., molded foam such as ethylene vinyl acetate foam, polyethylene foam, polyurethane foam, polypropylene foam, etc.; non-foam polymeric material such as thermoplastic polyurethane or any other elastomeric material, a gel, etc.) that is formed by a molding process such that the outer cover 42 is a molded cover, such as described, for instance, in U.S. Patent Application Publication 2015/0033433 incorporated by reference herein. In some cases, the material 67 of the outer cover 42 may form one layer of the outer cover 42 which may comprises one or more other layers of one or more other materials (e.g., a foam layer and a non-foam layer).

The protective padding 40 of the pad member $52_i$ provides padded protection to the goalie's leg $16_x$. A padding material 70 of the protective padding 40 may be of any suitable kind. For example, in some embodiments, the padding material 70 may be foam, such as polyurethane foam, ethylene vinyl acetate foam, polypropylene foam, polyethylene foam, vinyl nitrile foam, or any other suitable foam. As another example, in some embodiments, the padding material 70 may be other than foam, such as a gel or any other suitable shock-absorbing material.

In some cases, the padding material 70 of the protective padding 40 may form one padding layer of the protective padding 40 which may comprises one or more other padding layers of one or more other padding materials (e.g., layers of different foams; a foam layer and a non-foam layer; etc.).

The inner liner 44 of the pad member $52_i$ is configured to face the goalie's leg $16_x$. A material 76 of the inner layer 44 may be of any suitable kind. For example, in some embodiments, the material 76 may be fabric such as a woven fabric, a nonwoven fabric, synthetic microfibers, a synthetic woven knit, a polyurethane laminate, a mesh, or any other suitable fabric. The inner liner 44 may be implemented in various other ways in other embodiments.

The outer cover 42, the inner liner 44, and the protective padding 40 of the pad member $52_i$ may be connected together in any suitable way. For example, in some embodiments, two or more of the outer cover 42, the inner liner 44, and the protective padding 40 may be fastened by one or more fasteners, such as a stitching (i.e., a series of stitches), an adhesive, a series of staples, one or more laces, etc.

In this embodiment, the goalie pad $\mathbf{10}_x$ comprises an adjustment system 45 configured to adjust one or more of the pad members $\mathbf{52}_1$-$\mathbf{52}_7$ for adjusting how it fits on the goalie's leg $\mathbf{16}_x$. The adjustment system 45 may be relatively light, easy to use, and simple to manufacture.

More particularly, in this embodiment, the adjustment system 45 is configured to adjust the lateral knee wing 39 comprising the pad member $\mathbf{52}_3$ so that the knee portion 31 of the goalie pad $\mathbf{10}_x$ better fits about the goalie's knee 19. The adjustment system 45 thus allows the lateral knee wing 39 to be adjusted relative to a remainder of the goalie pad $\mathbf{10}_x$ including the main pad member $\mathbf{52}_1$. For instance, the adjustment system 45 may be used to adjust a position at which the lateral knee wing 39 is connected to the main pad member $\mathbf{52}_1$ such that it is relatively more outward in order to increase space for the goalie's knee 19 or relatively more inward in order to reduce space for the goalie's knee 19.

With additional reference to FIGS. 6A to 6D, in this embodiment, the adjustment system comprises connectors $\mathbf{55}_1$, $\mathbf{55}_2$ of the main pad member $\mathbf{52}_1$ and connectors $\mathbf{56}_1$, $\mathbf{56}_2$ of the lateral knee wing 39 that are connected to one another and allow the lateral knee wing 39 to be adjusted relative to the main pad member $\mathbf{52}_1$. The connectors $\mathbf{55}_1$, $\mathbf{55}_2$ of the main pad member $\mathbf{52}_1$ and the connectors $\mathbf{56}_1$, $\mathbf{56}_2$ of the lateral knee wing 39 are thus selectively engageable to and disengageable from one another to adjust the position of the lateral knee wing 39 relative to the main pad member $\mathbf{52}_1$.

In this example, the position of the lateral knee wing 39 relative to the main pad member $\mathbf{52}_1$ may thus be any one of a plurality of different positions $P_1$-$P_3$ which are spaced in the lateral direction of the goalie pad $\mathbf{10}_x$. Also, in this example, the connectors $\mathbf{55}_1$, $\mathbf{55}_2$ of the main pad member $\mathbf{52}_1$ and the connectors $\mathbf{56}_1$, $\mathbf{56}_2$ of the lateral knee wing 39 detachably connect the lateral knee wing 39 to the main pad member $\mathbf{52}_1$ such that the lateral knee wing 39 is detachable from the main pad member $\mathbf{52}_1$. This may facilitate adjustment, cleaning, replacement, etc. of the lateral knee wing 39.

The connector $\mathbf{55}_1$ of the main pad member $\mathbf{52}_1$ and the connector $\mathbf{56}_1$ of the lateral knee wing 39 will be further described with an understanding that a similar description applies to the connector $\mathbf{55}_2$ of the main pad member $\mathbf{52}_1$ and the connector $\mathbf{56}_2$ of the lateral knee wing 39.

In this embodiment, the connector $\mathbf{55}_1$ of the main pad member $\mathbf{52}_1$ and the connector $\mathbf{56}_1$ of the lateral knee wing 39 are connected to one another hook-and-loop fastenerlessly, i.e., connected to one another without any hook-and-loop fastener. That is, the connector $\mathbf{55}_1$ of the main pad member $\mathbf{52}_1$ and the connector $\mathbf{56}_1$ of the lateral knee wing 39 are free of (i.e., do not have) any hook-and-loop fastener (e.g., a VELCRO®fastener) required to connect them to one another. The connector $\mathbf{55}_1$ of the main pad member $\mathbf{52}_1$ and the connector $\mathbf{56}_1$ of the lateral knee wing 39 are thus connected to one other than by a hook-and-loop fastener. This may help to reduce weight of the adjustment system 45 and thus of the goalie pad $\mathbf{10}_x$ and facilitate manufacturing.

More particularly, in this embodiment, the connector $\mathbf{56}_1$ of the lateral knee wing 39 is connected to the connector $\mathbf{55}_1$ of the main pad member $\mathbf{52}_1$ without folding back onto the lateral knee wing 39. This may reduce the weight of the adjustment system 45 and thus of the goalie pad $\mathbf{10}_x$ by using less material.

In this example, the connector $\mathbf{56}_1$ of the lateral knee wing 39 comprises an elongated portion 62 and an enlarged portion 64 that is larger than the elongated portion 62 and configured to retain the connector $\mathbf{56}_1$ of the lateral knee wing 39 with the connector $\mathbf{55}_1$ of the main pad member $\mathbf{52}_1$. The connector $\mathbf{55}_1$ of the main pad member $\mathbf{52}_1$ comprises openings $\mathbf{82}_1$-$\mathbf{82}_3$ and the connector $\mathbf{56}_1$ extends into two consecutive ones of the openings $\mathbf{82}_1$-$\mathbf{82}_3$ to connect the lateral knee wing 39 to the main pad member $\mathbf{52}_1$.

In this embodiment, with additional reference to FIGS. 7 to 11, the enlarged portion 64 of the connector $\mathbf{56}_1$ of the lateral knee wing 39 comprises a material 68 which is more rigid than a material 66 of the elongated portion 62. In other words, the material 68 of the enlarged portion 64 of the connector $\mathbf{56}_1$ is stiffer than the material 66 of the elongated portion 62 of the connector $\mathbf{56}_1$. For example, in some cases, the material 68 of the enlarged portion 64 of the connector $\mathbf{56}_1$ is a rigid polymeric material.

More particularly, in this embodiment, the elongated portion 62 of the connector $\mathbf{56}_1$ of the lateral knee wing 39 comprises a strap 72. The strap 72 may be suitably strong to enable a user to properly tighten the connectors $\mathbf{55}_1$, $\mathbf{56}_1$. In particular, the strap 72 comprises a material 74 having a strength and a modulus of elasticity allowing the strap 72 to provide a stable connection. For example, in some embodiments, the material 74 of the strap 72 may be unstretchable (i.e., not stretchable) during adjustment of the lateral knee wing 39. For instance, in some embodiments, the material 74 of the strap 72 may be nylon, polypropylene or any other suitably strong polymeric material.

The strap 72 has a length $L_S$ which is suitable for easily connecting two consecutive ones of the openings $\mathbf{82}_1$-$\mathbf{82}_3$, but not too large to prevent a spacing between the lateral knee wing 39 and the main pad member $\mathbf{52}_1$. For example, in some cases, the length $L_S$ is between 5 mm and 25 mm, in some cases between 10 mm and 20 mm, and in some cases about 15 mm. The strap 72 also has a width $W_S$ which is suitable for resisting to forces applied on the strap 72 by the lateral knee wing 39, but not too large to minimize a weight of the strap 72. For example, in some cases, the width $W_S$ is between 2 mm and 20 mm, in some cases between 5 mm and 15 mm, in some cases about 10 mm.

In this embodiment, the enlarged portion 64 of the connector $\mathbf{56}_1$ of the lateral knee wing 39 comprises a button 76. The button 76 is attached to the strap 72 and engages one of the openings $\mathbf{82}_1$-$\mathbf{82}_3$ of the connector $\mathbf{55}_1$ to retain the lateral knee wing 39 to the main pad member $\mathbf{52}_1$. This may be achieved in many suitable ways. In this example, the button 76 has an elliptical section and a thickness $T_B$. In other cases, the button 76 may have a circular section, a polygonal section, or any shape of section.

The thickness $T_B$ of the button 76 is suitable to allow the button 76 to resist to compressive forces, for example while the strap 72 is being pulled and the button 76 is being compressed by an action of the goalie during play. The thickness $T_B$ of the button 76 is also suitable to facilitate the insertion of the button 76 into the openings $\mathbf{82}_1$-$\mathbf{82}_3$. For example, in some cases, the thickness $T_B$ is between 0.5 mm and 5 mm, in some cases between 1 mm and 3 mm, in some cases about 2 mm. The button 76 comprises the material 68 having a suitable modulus of elasticity to retain the lateral knee wing 39 to the main pad member $\mathbf{52}_1$, for example while the strap 72 is being pulled and the button 76 is being compressed by an action of the goalie during play.

In this embodiment, the button 76 is attached to the strap 72 by mechanical interlock. The button 76 comprises elongated apertures $\mathbf{77}_1$-$\mathbf{77}_A$ and the strap 72 comprises a closed loop section 78 interlocking the button 76 as the strap 72 goes through the apertures $77_1$-$77_A$. In other embodiments, the button 76 may be attached to the strap 72 by other suitable means, for example by being molded to one another, by being glued to one another, by being stitched to one another, by being integrally formed together, etc.

With additional reference to FIGS. 12 to 15, in this embodiment, the connectors $56_1$, $56_2$ of the lateral knee wing 39, are spaced from each other by a spacing $S_c$ in the longitudinal direction of the goalie pad $10_x$, and suitable to sufficiently stabilize the lateral knee wing 39 to the main pad member $52_1$. For example, in some cases, the spacing $S_c$ may be at least 50 mm, in some cases at least 75 mm, in some cases at least 100 mm, in some cases even more.

Attachment of the connector $56_1$ of the lateral knee wing 39 to the connector $55_1$ of the main pad member $52_1$ is achieved by entering the connector $56_1$ in a first one of the openings $82_1$-$82_3$ and taking the connector $55_1$ out through a second one of the openings $82_1$-$82_3$. More particularly, the enlarged portion 64 of the connector $56_1$ is engaged to the second one of the openings $82_1$-$82_3$ of the connector $55_1$, while the lateral knee wing 39 is adjacent to the first one of the openings $82_1$-$82_3$. In this embodiment, the button 76 is manually entered in the first one of the openings $82_1$-$82_3$ and taken out of the second one of the openings $82_1$-$82_3$. The button 76 may be manipulated to get through the openings $82_1$-$82_3$ by being rotated to minimize a section of the button 76 otherwise parallel to the openings $82_1$-$82_3$. After the button 76 is entered and taken out of the second one of the openings $82_1$-$82_3$, the button 76 engages the second one of the openings $82_1$-$82_3$ when the strap 72 is being pulled upon, and a combination of the dimensions of the section of the button 76 and an attachment of the button 76 to the strap 72 refrains the button 76 from re-entering the second one of the openings $82_1$-$82_3$ while the strap 72 is being pulled upon.

As the first and the second ones of the openings $82_1$-$82_3$ may be any ones of the openings $82_1$-$82_3$, the lateral knee wing 39 may be affixed to the main pad member $52_1$ in the plurality of positions $P_1$-$P_3$ comprising as many positions $P_i$ as there are openings $82_1$-$82_3$. This allows the lateral knee wing 39 to be adjustable relative to the main pad member $52_1$.

In this embodiment, each of the openings $82_1$-$82_3$ of the connector $55_1$ of the main pad member $52_1$ comprises two enlargements $84_1$, $84_2$ spaced from each other facilitating the insertion of the button 76 and/or preventing a propagation of the openings $82_1$-$82_3$ through the connector $55_1$ of use.

The connector $55_1$ of the main pad member $52_1$ has dimensions facilitating the use of the adjustment system 45, limiting the weight of the adjustment system 45, and suitable to resist to forces, for example while the strap 72 is being pulled and the button 76 is being compressed onto the connector $55_1$ by an action of the goalie during play. For example, the connector $55_1$ has a dimension (e.g., width) $W_C$ in the longitudinal direction of the goalie pad $10_x$. For instance, in some embodiments, the width $W_C$ may be between 10 mm and 50 mm, in some cases between 20 mm and 40 mm, and in some cases about 30 mm. The connector $55_1$ also has a dimension (e.g., length) $L_C$ in the lateral direction of the goalie pad $10_x$. For instance, in some embodiments, the length $L_C$ may be between 40 mm and 100 mm, in some cases between 50 mm and 90 mm, in some cases 60 mm and 80 mm, and in some cases about 70 mm.

The width $W_c$ of the connector $55_1$ of the main pad member $52_1$ is smaller than a dimension (e.g., width) $W_{KW}$ of the lateral knee wing 39 in the longitudinal direction of the goalie pad $10_x$. For example, in some cases, a ratio of the width $W_c$ of the connector $55_1$ over the width $W_{KW}$ of the lateral knee wing 39 is less than ¾, in some cases less than ⅔, in some cases less than ½, and in some cases even less.

Similarly, the openings $82_1$-$82_3$ have dimensions facilitating the use of the adjustment system 45, increasing an adjustability of the adjustment system 45, and suitable to resist to forces, for example while the strap 72 is being pulled and the button 76 is being compressed onto the connector $55_1$ by an action of the goalie during play. For example, each of the openings $82_1$-$82_3$ is spaced from a next one of the openings $82_1$-$82_3$ by a spacing $S_E$ substantially parallel to the lateral direction of the goalie pad $10_x$, the spacing $S_E$ being in some cases between 5 mm and 25 mm, in some cases between 10 mm and 20 mm, and in some cases about 15 mm. Also, the enlargements $84_1$, $84_2$ of the openings $82_1$-$82_3$ are spaced from each other by a width $W_E$ of the openings $82_1$-$82_3$ substantially parallel to the longitudinal direction of the goalie pad $10_x$, the width $W_E$ being in some cases between 5 mm and 25 mm, in some cases between 10 mm and 20 mm, and in some cases about 15 mm.

The connector $55_1$ of the main pad member $52_1$ may be attached to a remainder of the main pad member $52_1$ in any suitable way. In this example, a stitching 90 connects the connector $55_1$ to the main pad member $52_1$. For example, the stitching 90 of the connector $55_1$ to the inner liner 44 may occupy less than half of the length $L_C$ of the connector $55_1$, in some cases less than one third of the length $L_C$ of the connector $55_1$, in some cases less than one quarter of the length $L_C$ of the connector $55_1$, in some cases event less. Also, in this example, the connector $55_1$ is stitched to the inner liner 44 only at longitudinal end parts $92_1$, $92_2$ of the connector $55_1$ to leave a spacing 86 between the connector $55_1$ and the inner liner 44 of the main pad member $52_1$ which can be occupied by the connector $56_1$ of the lateral knee wing 39. The stitching 90 of the connector $55_1$ to the inner liner 44 does not overlap with the openings $82_1$-$82_3$ in the lateral direction of the leg pad 10 to allow the connector $56_1$ of the lateral knee wing 39 to connect with two of the openings $82_1$-$82_3$ in the spacing 86.

The connectors $55_1$, $55_2$, of the main pad member $52_1$ are spaced from each other by a spacing $S_{cp}$ in the longitudinal direction of the goalie pad $10_x$, suitable to sufficiently stabilize the lateral knee wing 39 to the main pad member $52_1$, and about as large as the spacing $S_c$ between the connectors $56_1$, $56_2$. For example, in some cases, the spacing $S_{cp}$ may be at least 50 mm, in some cases at least 75 mm, in some cases at least 100 mm, in some cases even more.

The goalie pad $10_x$, including the adjustment system 45, may be constructed in various other ways in other embodiments.

Figure 16:
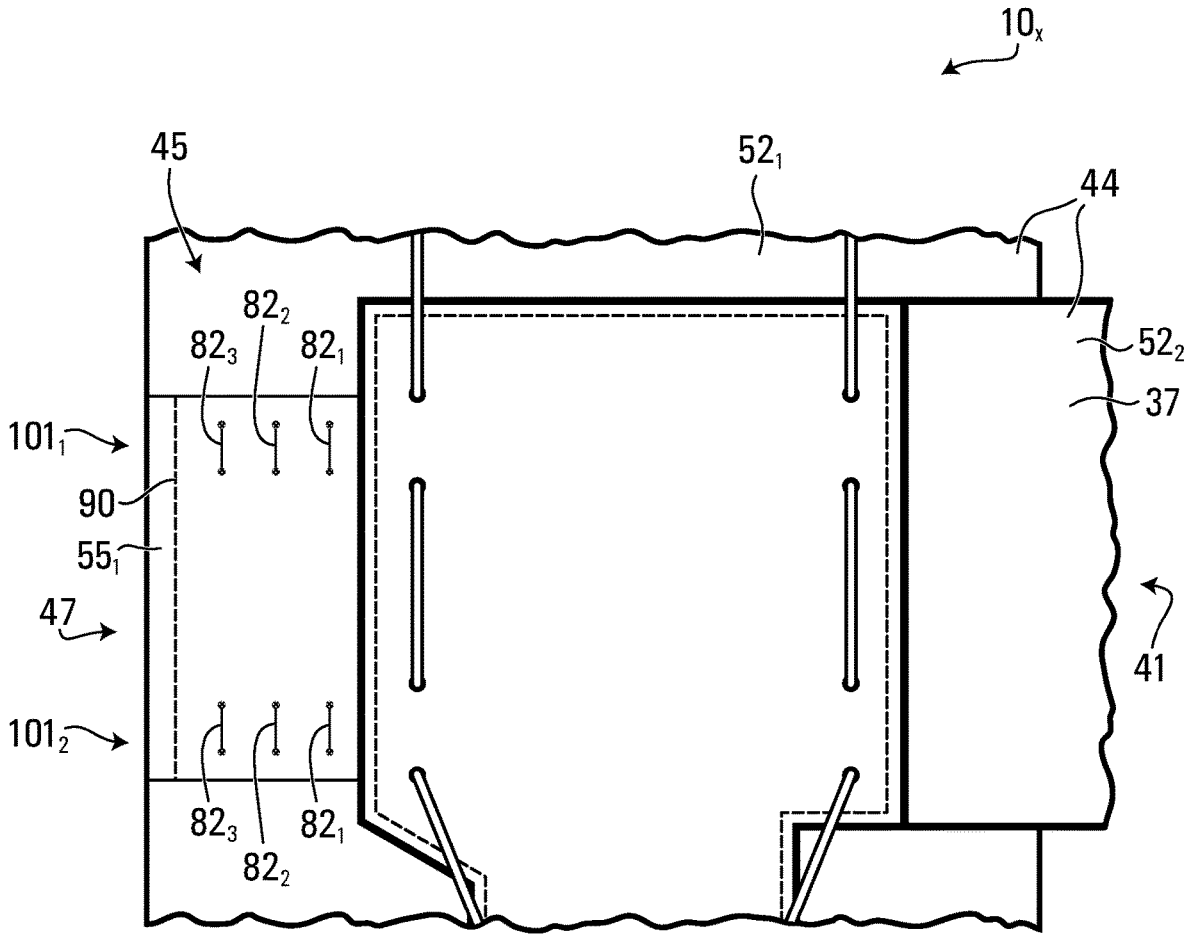
FIGS. 16 to 22 show variants of hockey goalkeeper leg pads for protecting legs of a hockey goalkeeper.

For example, as shown in FIG. 16, in some embodiments, the adjustment system 45 may comprise a sole connector $55_1$. The connector $55_1$ may comprise rows $101_1$, $101_2$ of openings $82_1$-$82_3$.

Figure 17:
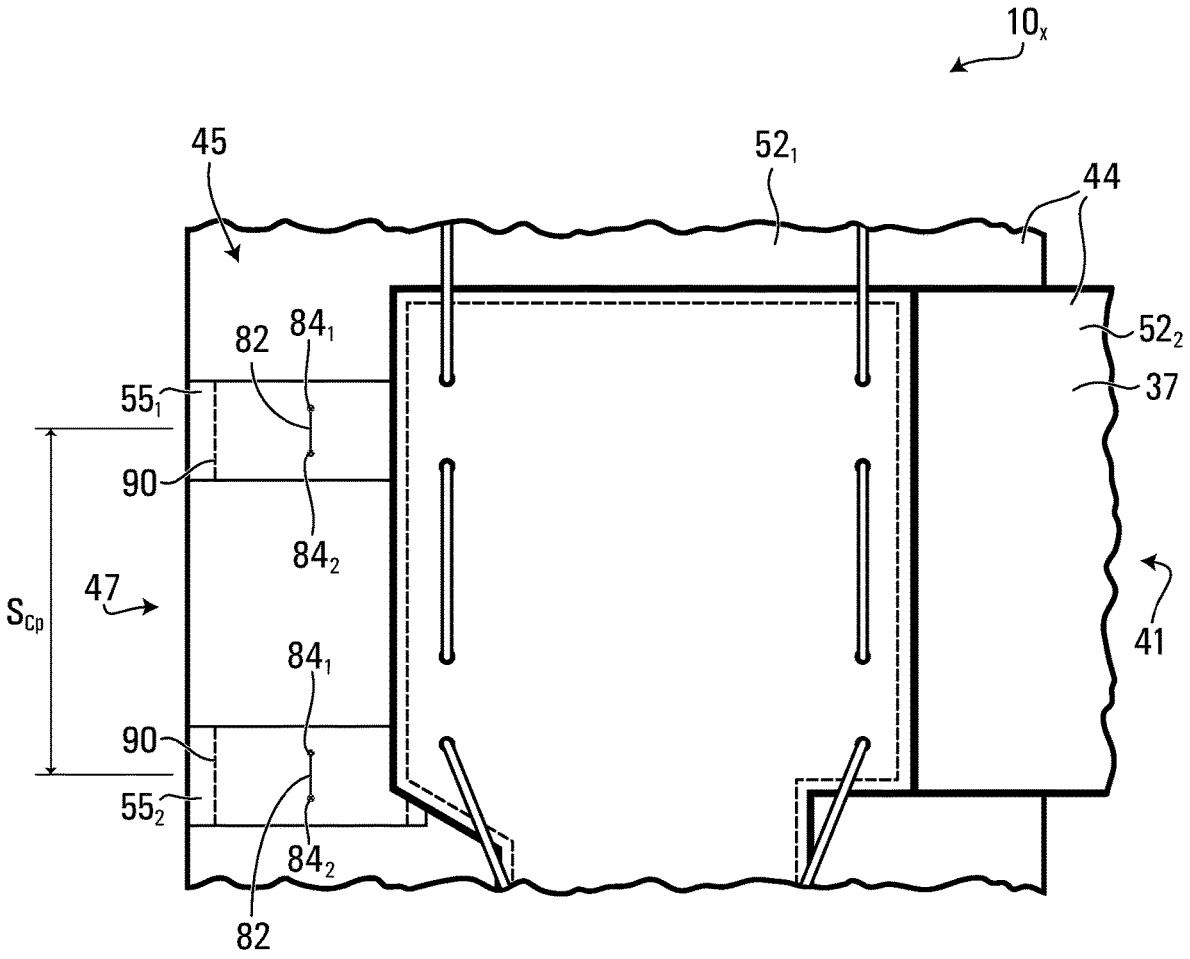

As shown in FIG. 17, in some embodiments, each of the connectors $55_1$, $55_2$ may comprise only one opening 82.

Figure 18:
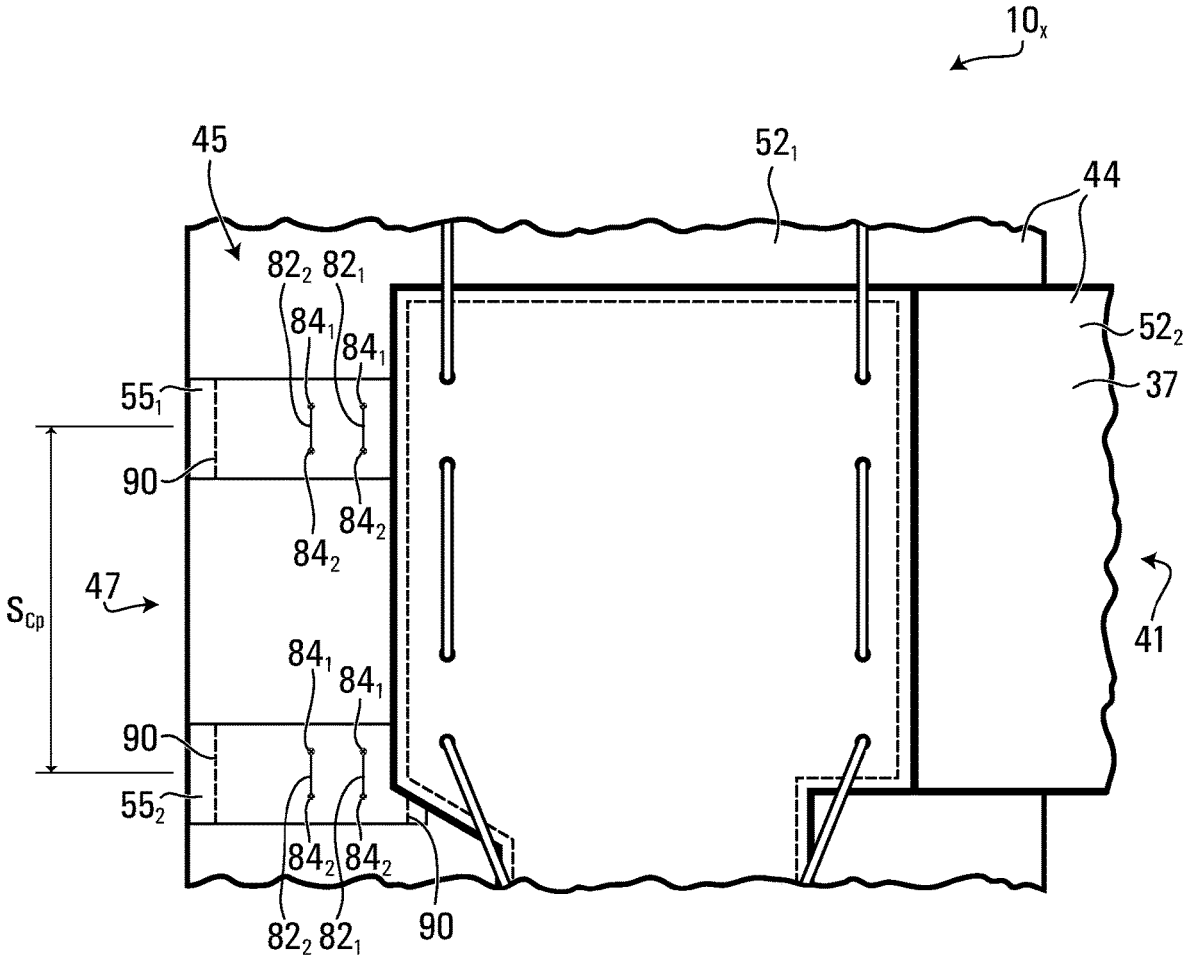
Figure 19:
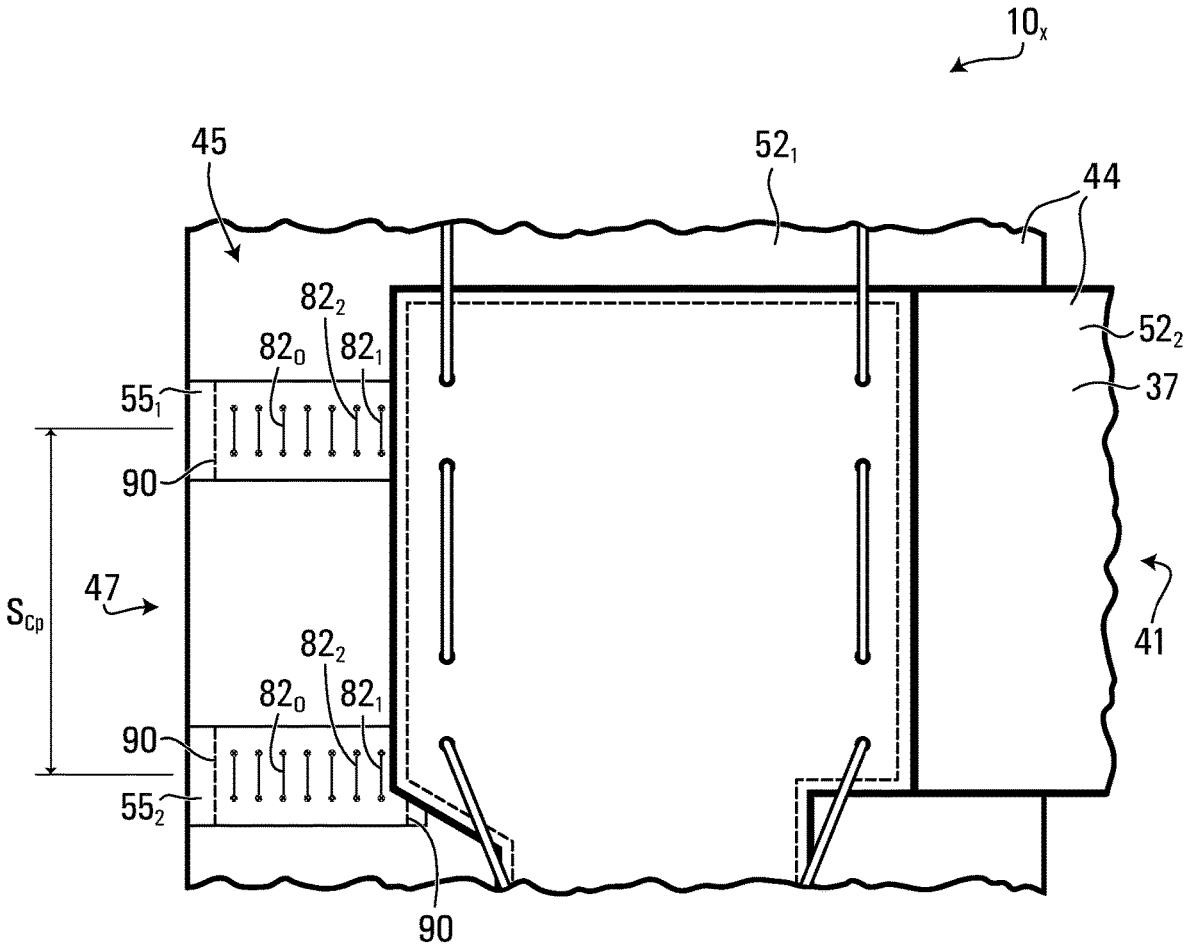

As shown in FIGS. 18 and 19, in some embodiments, each of the connectors $55_1$, $55_2$ may comprise a plurality of openings $82_1$-$82_O$, the plurality of openings $82_1$-$82_O$ comprising in some cases two openings $82_1$, $82_2$, or in some cases more than three openings $82_1$-$82_O$.

Figure 20:
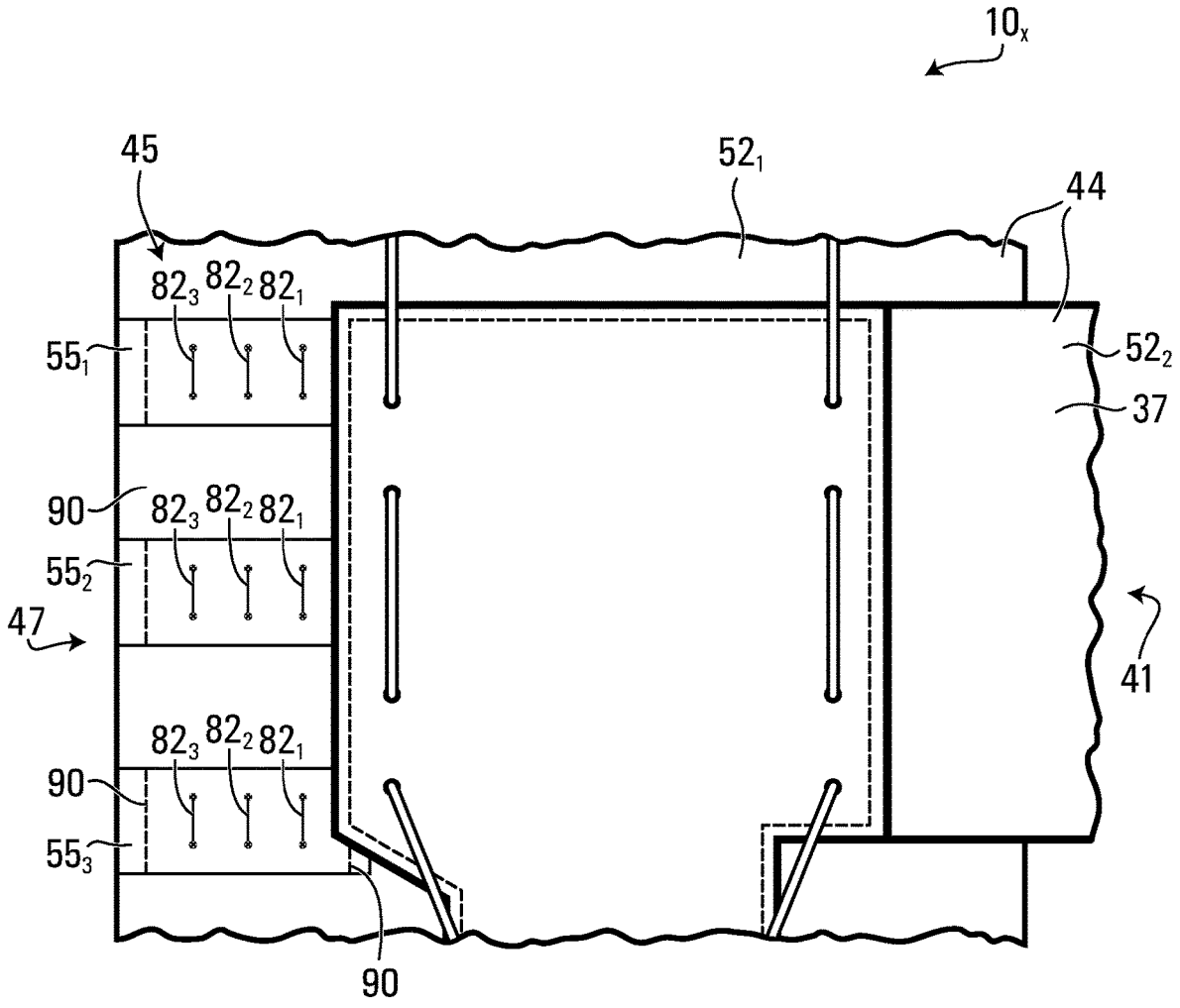
Figure 21:
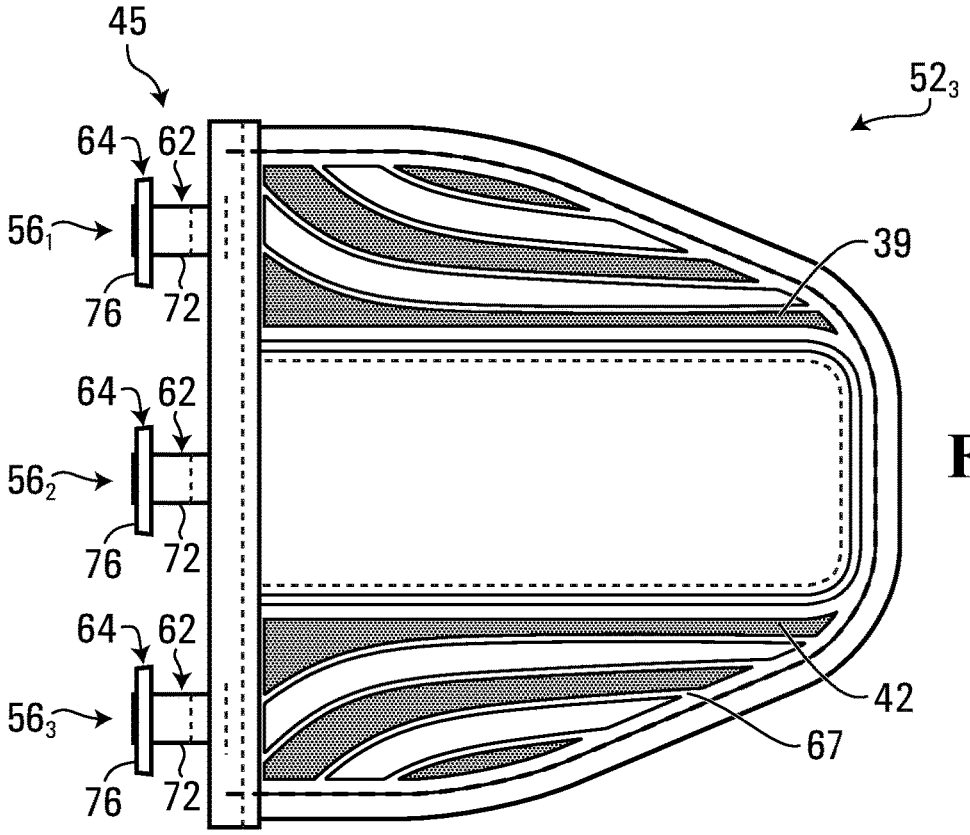

As shown in FIGS. 20 and 21, in some embodiments, the main pad member $52_1$ may comprise more than two connectors $55_1$-$55_C$ and the lateral knee wing 39 may comprise more than 2 connectors $56_1$-$56_C$.

Figure 22:
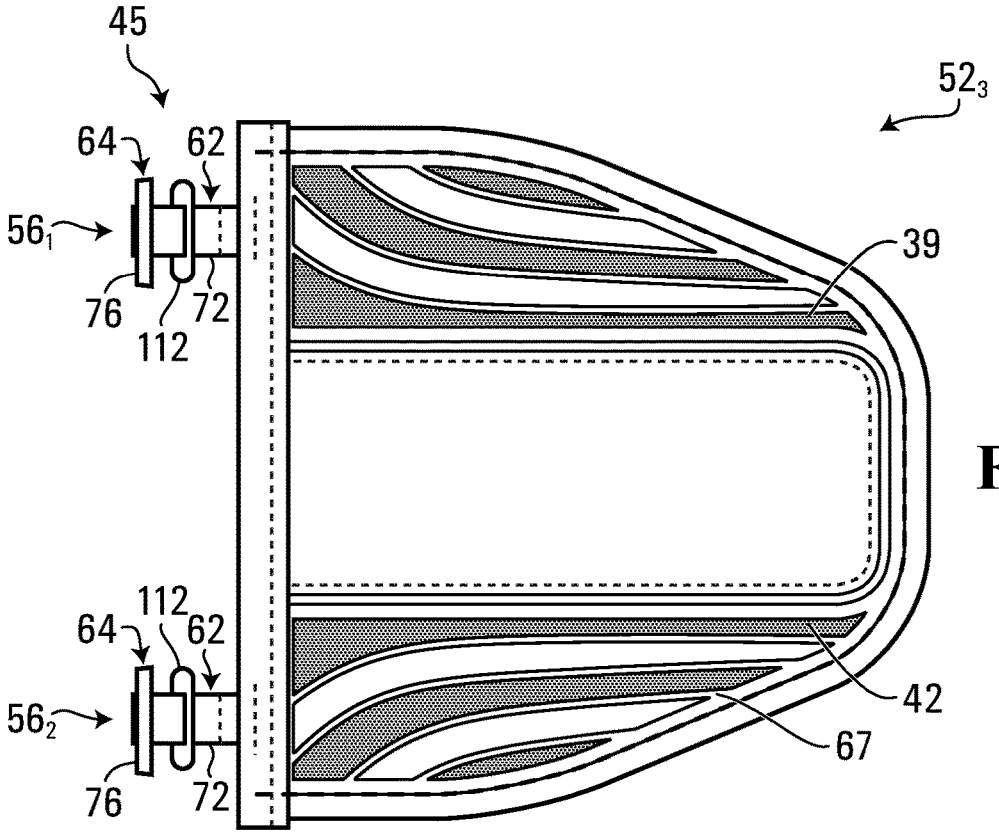

As shown in FIG. 22, in some embodiments, each of the connectors $56_1$, $56_2$ of the lateral knee wing 39 may have an adjustable length. For example, the elongate section 62 may comprise a loop 112 allowing the strap 72 to have an adjustable length, thus enhancing the adjustability of the adjustment system 45.

As another example, in some embodiments, the strap 72 may be elastic to be stretchable during adjustment of the lateral knee wing 39. In that case, the modulus of elasticity of the material 74 of the strap 72 may be lower than when the strap 72 is not stretchable during adjustment.

As another example, in other embodiments, the adjustment system 45 may be configured to adjust one or more of the pad members $\mathbf{52}_1$-$\mathbf{52}_7$ other than or in addition to the pad member $\mathbf{52}_3$ of the lateral knee wing 39, in a manner similar to that discussed above in relation to the lateral knee wing 39. For example, in some embodiments, the adjustment system 45 may be configured to adjust one or more of the medial knee wing 37 comprising the pad member $\mathbf{52}_2$, the knee landing 43 comprising the pad member $\mathbf{52}_4$, the medial calf wing 49 comprising the pad member $\mathbf{52}_5$, the lateral calf wing 61 comprising the pad member $\mathbf{52}_6$, and/or the calf landing 63 comprising the pad member $\mathbf{52}_7$ relative to the main pad member $\mathbf{52}_1$.

As another example, in other embodiments, the goalie pads $\mathbf{10}_1$, $\mathbf{10}_2$ may have any other suitable shape and/or be made of any other suitable material.

Although in embodiments considered above the goalie pads $\mathbf{10}_1$, $\mathbf{10}_2$ are designed for playing ice hockey, in other embodiments, hockey goalkeeper leg pads constructed using principles described herein in respect of the goalie pads $\mathbf{10}_1$, $\mathbf{10}_2$ can be hockey goalkeeper leg pads for playing roller hockey or another type of hockey (e.g., field or street hockey) on a dry playing surface (e.g., a polymeric, concrete, wooden, or turf playing surface or any other dry playing surface on which roller hockey or field or street hockey is played).

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Any feature of any embodiment discussed herein may be combined with any feature of any other embodiment discussed herein in some examples of implementation.

In case of any discrepancy, inconsistency, or other difference between terms used herein and terms used in any document incorporated by reference herein, meanings of the terms used herein are to prevail and be used.

Although various embodiments and examples have been presented, this was for purposes of description, but should not be limiting. Various modifications and enhancements will become apparent to those of ordinary skill in the art.

The invention claimed is:

1. A hockey goalkeeper leg pad wearable on a leg of a hockey goalkeeper to protect the leg, the hockey goalkeeper leg pad comprising:

a first pad member configured to overlie and protect an upper leg region, a knee and a lower leg region of the leg;

a second pad member fastened to and projecting rearwardly from the first pad member; and an adjustment system configured to adjust the second pad member relative to the first pad member, the adjustment system comprising a connector of the first pad member and a connector of the second pad member that are connected to one another hook-and-loop fastenerlessly, are located where the second pad member is fastened to and projects rearwardly from the first pad member, and allow where the second pad member is fastened to and projects rearwardly from the first pad member to be adjusted;

wherein the connector of the first pad member and the connector of the second pad member detachably connect the second pad member to the first pad member such that the second pad member is detachable from the first pad member.

2. The hockey goalkeeper leg pad of claim 1, wherein the connector of the second pad member is connected to the connector of the first pad member without folding back onto the second pad member.

3. The hockey goalkeeper leg pad of claim 1, wherein the connector of the first pad member comprises an opening and the connector of the second pad member extends into the opening to connect the second pad member to the first pad member.

4. The hockey goalkeeper leg pad of claim 3, wherein the connector of the second pad member comprises an elongated portion and an enlarged portion that is larger than the elongated portion and configured to retain the connector of the second pad member into the opening of the connector of the first pad member.

5. The hockey goalkeeper leg pad of claim 4, wherein the elongated portion of the connector of the second pad member comprises a strap.

6. The hockey goalkeeper leg pad of claim 5, wherein the strap is unstretchable during adjustment of the second pad member relative to the first pad member.

7. The hockey goalkeeper leg pad of claim 4, wherein a material of the enlarged portion of the connector of the second pad member is stiffer than a material of the elongated portion of the connector of the second pad member.

8. The hockey goalkeeper leg pad of claim 7, wherein the material of the enlarged portion of the connector of the second pad member is a rigid polymeric material.

9. The hockey goalkeeper leg pad of claim 4, wherein the enlarged portion of the connector of the second pad member comprises a button.

10. The hockey goalkeeper leg pad of claim 3, wherein the opening of the connector of the first pad member comprises an enlargement where a boundary forming the opening has an increased width.

11. The hockey goalkeeper leg pad of claim 10, wherein the enlargement of the opening of the connector of the first pad member is a first enlargement and the opening of the connector of the first pad member comprises a second enlargement spaced from the first enlargement and where the boundary forming the opening has the increased width.

12. The hockey goalkeeper leg pad of claim 1, wherein the connector of the first pad member comprises a plurality of openings and the connector of the second pad member is extendable into any one of the openings to connect the second pad member to the first pad member at a plurality of different positions.

13. The hockey goalkeeper leg pad of claim 1, wherein the connector of the second pad member comprises an elongated portion and an enlarged portion that is larger than the elongated portion and configured to retain the connector of the second pad member with connector of the first pad member.

14. The hockey goalkeeper leg pad of claim 1, wherein the first pad member comprises an inner liner and the connector of the first pad member is stitched to the inner liner.

15. The hockey goalkeeper leg pad of claim 14, wherein a stitching of the connector of the first pad member to the inner liner occupies less than half of a dimension of the connector of the first pad member in a lateral direction of the hockey goalkeeper leg pad.

16. The hockey goalkeeper leg pad of claim 15, wherein the stitching of the connector of the first pad member to the inner liner occupies less than one-third of the dimension of the connector of the first pad member in the lateral direction of the hockey goalkeeper leg pad.

17. The hockey goalkeeper leg pad of claim 15, wherein the stitching of the connector of the first pad member to the inner liner occupies less than one-quarter of the dimension of the connector of the first pad member in the lateral direction of the hockey goalkeeper leg pad.

18. The hockey goalkeeper leg pad of claim 14, wherein the connector of the first pad member is stitched to the inner liner only at longitudinal end parts of the connector of the first pad member.

19. The hockey goalkeeper leg pad of claim 14, wherein the connector of the first pad member comprises a plurality of openings, the connector of the second pad member is extendable into any one of the openings to connect the second pad member to the first pad member at a plurality of different positions, and a stitching of the connector of the first pad member to the inner liner does not overlap with the openings in a lateral direction of the hockey goalkeeper leg pad.

20. The hockey goalkeeper leg pad of claim 1, wherein a dimension of the connector of the first pad member in a longitudinal direction of the hockey goalkeeper leg pad is less than a dimension of the second pad member in the longitudinal direction of the hockey goalkeeper leg pad.

21. The hockey goalkeeper leg pad of claim 20, wherein the dimension of the connector of the first pad member in the longitudinal direction of the hockey goalkeeper leg pad is less than three-quarters of the dimension of the second pad member in the longitudinal direction of the hockey goalkeeper leg pad.

22. The hockey goalkeeper leg pad of claim 20, wherein the dimension of the connector of the first pad member in the longitudinal direction of the hockey goalkeeper leg pad is less than two-thirds of the dimension of the second pad member in the longitudinal direction of the hockey goalkeeper leg pad.

23. The hockey goalkeeper leg pad of claim 20, wherein the dimension of the connector of the first pad member in the longitudinal direction of the hockey goalkeeper leg pad is less than half of the dimension of the second pad member in the longitudinal direction of the hockey goalkeeper leg pad.

24. The hockey goalkeeper leg pad of claim 1, wherein the connector of the first pad member is a first connector of the first pad member, the connector of the second pad member is a first connector of the second pad member, and the adjustment system comprises a second connector of the first pad member and a second connector of the second pad member that are connected to one another hook-and-loop fastenerlessly, are located where the second pad member is fastened to and projects rearwardly from the first pad member, and allow where the second pad member is fastened to and projects rearwardly from the first pad member to be adjusted.

25. The hockey goalkeeper leg pad of claim 24, wherein the first connector of the first pad member and the second connector of the first pad member are separate and spaced apart from one another.

26. The hockey goalkeeper leg pad of claim 24, wherein each of a dimension of the first connector of the first pad member in a longitudinal direction of the hockey goalkeeper leg pad and a dimension of the second connector of the first pad member in the longitudinal direction of the hockey goalkeeper leg pad is less than a dimension of the second pad member in the longitudinal direction of the hockey goalkeeper leg pad.

27. The hockey goalkeeper leg pad of claim 1, wherein the first pad member is configured to overlie and protect a foot of the leg and the second pad member is a knee pad member projecting rearwardly from the first pad member.

28. The hockey goalkeeper leg pad of claim 1, wherein the knee pad member is a lateral knee wing.

29. The hockey goalkeeper leg pad of claim 1, wherein: the second pad member comprises a front end portion and a rear end portion; the connector of the second pad member is located at the front end portion; and the rear end portion is free.

30. The hockey goalkeeper leg pad of claim 1, wherein the connector of the first pad member and the connector of the second pad member allow where the second pad member is fastened to and projects rearwardly from the first pad member to be adjusted in a widthwise direction of the hockey goalkeeper leg pad.

31. A hockey goalkeeper leg pad wearable on a leg of a hockey goalkeeper to protect the leg, the hockey goalkeeper leg pad comprising:

a first pad member configured to overlie and protect an upper leg region, a knee and a lower leg region of the leg;

a second pad member connected to and projecting rearwardly from the first pad member; and an adjustment system configured to adjust the second pad member relative to the first pad member, the adjustment system comprising a connector of the first pad member and a connector of the second pad member that are connected to one another hook-and-loop fastenerlessly and allow the second pad member to be adjusted relative to the first pad member;

wherein a dimension of the connector of the first pad member in a longitudinal direction of the hockey goalkeeper leg pad is less than a dimension of the second pad member in the longitudinal direction of the hockey goalkeeper leg pad.

32. A hockey goalkeeper leg pad wearable on a leg of a hockey goalkeeper to protect the leg, the hockey goalkeeper leg pad comprising:

a first pad member configured to overlie and protect an upper leg region, a knee and a lower leg region of the leg;

a second pad member fastened to and projecting rearwardly from the first pad member; and an adjustment system configured to adjust the second pad member relative to the first pad member, the adjustment system comprising a connector of the first pad member and a connector of the second pad member that are connected to one another hook-and-loop fastenerlessly, are located where the second pad member is fastened to and projects rearwardly from the first pad member, and allow where the second pad member is fastened to and projects rearwardly from the first pad member to be adjusted;

wherein the connector of the first pad member comprises an opening and the connector of the second pad member extends into the opening to connect the second pad member to the first pad member.

33. A hockey goalkeeper leg pad wearable on a leg of a hockey goalkeeper to protect the leg, the hockey goalkeeper leg pad comprising:

a first pad member configured to overlie and protect an upper leg region, a knee and a lower leg region of the leg;

a second pad member fastened to and projecting rearwardly from the first pad member; and an adjustment system configured to adjust the second pad member relative to the first pad member, the adjustment system comprising a connector of the first pad member and a connector of the second pad member that are connected to one another hook-and-loop fastenerlessly, are located where the second pad member is fastened to and projects rearwardly from the first pad member, and allow where the second pad member is fastened to and projects rearwardly from the first pad member to be adjusted wherein the connector of the first pad member comprises a plurality of openings and the connector of the second pad member is extendable into any one of the openings to connect the second pad member to the first pad member at a plurality of different positions.

* * * * *